US007868741B2

(12) United States Patent
Imai et al.

(10) Patent No.: US 7,868,741 B2
(45) Date of Patent: Jan. 11, 2011

(54) MEDICATION MANAGING APPARATUS

(75) Inventors: Yutaka Imai, 4-20-56, Nakayama, Aoba-ku, Sendai-shi, Miyagi (JP) 981-0952; Tomonori Inoue, Kyoto (JP); Kiichiro Miyata, Toyonaka (JP); Takahide Tanaka, Otsu (JP); Akihisa Narai, Taki-gun (JP); Bunichiro Ohe, Matsusaka (JP); Yukitoshi Kurata, Ise (JP)

(73) Assignees: Yutaka Imai, Sendai-shi (JP); OMRON HEALTHCARE Co., Ltd., Kyoto-shi (JP)

( * ) Notice: Subject to any disclaimer, the term of this patent is extended or adjusted under 35 U.S.C. 154(b) by 778 days.

(21) Appl. No.: 11/817,219

(22) PCT Filed: Feb. 22, 2006

(86) PCT No.: PCT/JP2006/303162

§ 371 (c)(1),
(2), (4) Date: Aug. 27, 2007

(87) PCT Pub. No.: WO2006/093000

PCT Pub. Date: Sep. 8, 2006

(65) Prior Publication Data

US 2009/0261011 A1 Oct. 22, 2009

(30) Foreign Application Priority Data

Feb. 28, 2005 (JP) ..... 2005-052520

(51) Int. Cl.

| | |
|---|---|
| ***G08B 1/00*** | (2006.01) |
| ***G08B 21/00*** | (2006.01) |
| ***G08B 23/00*** | (2006.01) |
| ***G04B 47/00*** | (2006.01) |
| ***G04B 19/00*** | (2006.01) |

(52) U.S. Cl. ..... 340/309.16; 340/531; 340/540; 340/573.1; 368/10; 368/21

(58) Field of Classification Search ..... 340/309.16, 340/531, 540, 573.1; 368/10, 21
See application file for complete search history.

(56) References Cited

U.S. PATENT DOCUMENTS 5,408,443 A * 4/1995 Weinberger ..... 368/10

(Continued)

FOREIGN PATENT DOCUMENTS

JP 6-511183 12/1994

(Continued)

OTHER PUBLICATIONS

Search report for PCT/JP2006/303162, May 15, 2006.*

(Continued)

*Primary Examiner*—Benjamin C Lee
*Assistant Examiner*—Peter C Mehravari
(74) *Attorney, Agent, or Firm*—Morrison & Foerster LLP

(57) ABSTRACT

A medication managing apparatus includes a medicine package case and a main body unit removably storing the medicine package case. The medicine package case includes blocks each storing a medicine package, openings provided at walls of each block and formed at positions facing each other such that the medicine package stored in the block is sandwiched therebetween, and an openable/closable cover. The main body unit includes a sensor portion (a medicine package sensor) disposed corresponding to each opening at the opposing walls of each block, to sense a medicine package based on that the medicine package stored in the block blocks a gap between a pair of openings, and a switch lever and a microswitch (a medicine package case sensor) sensing attachment/removal of the medicine package case to/from the main body unit.

7 Claims, 25 Drawing Sheets

U.S. PATENT DOCUMENTS

| | | | | |
|---|---|---|---|---|
| 5,805,051 | A * | 9/1998 | Herrmann et al. | 340/309.4 |
| 6,281,798 | B1 * | 8/2001 | Laurent et al. | 340/573.1 |
| 7,006,894 | B2 * | 2/2006 | de la Huerga | 700/244 |
| 7,158,011 | B2 * | 1/2007 | Brue | 340/309.16 |
| 7,303,094 | B2 * | 12/2007 | Hutchinson et al. | 221/197 |
| 7,317,393 | B2 * | 1/2008 | Maloney | 340/568.1 |
| 7,424,888 | B2 * | 9/2008 | Harvey et al. | 128/203.15 |
| 2002/0093429 | A1 * | 7/2002 | Matsushita et al. | 340/573.1 |
| 2002/0149472 | A1 * | 10/2002 | Roe | 340/309.15 |
| 2003/0183642 | A1 * | 10/2003 | Kempker, Sr. | 221/2 |
| 2003/0231119 | A1 * | 12/2003 | Chiavetta et al. | 340/870.07 |
| 2004/0167408 | A1 * | 8/2004 | Ashida et al. | 600/485 |
| 2006/0022806 | A1 * | 2/2006 | Auerbach | 340/309.16 |
| 2009/0261011 | A1 * | 10/2009 | Imai et al. | 206/459.1 |

FOREIGN PATENT DOCUMENTS

| | | | |
|---|---|---|---|
| JP | 6511183 T | * | 12/1994 |
| JP | 8-505305 | | 6/1996 |
| JP | 8505305 T | * | 6/1996 |
| JP | 10-201827 | | 8/1998 |
| JP | 10201827 | * | 8/1998 |
| JP | 2002-291840 | | 10/2002 |
| JP | 2002291840 | * | 10/2002 |
| JP | 2002-360662 | | 12/2002 |
| JP | 2002-362652 | | 12/2002 |
| JP | 2002360662 | * | 12/2002 |
| JP | 2002362652 | * | 12/2002 |
| JP | 2003-310715 | | 11/2003 |
| JP | 2003310715 | * | 11/2003 |
| JP | 2004-181137 | | 7/2004 |
| JP | 2004181137 | * | 7/2004 |
| RU | 2 232 705 | | 7/2004 |
| WO | WO-94/15859 | | 7/1994 |

OTHER PUBLICATIONS

Russian Decision on Grant Patent for Invention mailed on Apr. 19, 2010, directed to corresponding Russian Patent Application No. 2007135949/14(039302); 10 pages.

International Search Report dated May 15, 2005, directed to counterpart PCT application PCT/JP2006/303162.

* cited by examiner

MEDICATION MANAGING APPARATUS

This application is a national stage application under 35 USC 371 of International Application No. PCT/JP2006/303162, filed Feb. 22, 2006, which claims the benefit of Japanese Patent Application No. 2005-052520, filed Feb. 28, 2005, the disclosures of which are hereby incorporated by reference.

TECHNICAL FIELD

The present invention relates to a medication managing apparatus that includes a main body unit that removably stores a medicine package case storing medicine packages containing medicines, that manages medication-related information including a medication instruction time, and that gives, at the medication instruction time, an instruction/notice of medication.

BACKGROUND ART

Conventionally, there has been an apparatus that includes a medicine storing portion having a plurality of compartments (blocks) for storing medicines to be taken, and that gives by voice or display, at the medication time, a notice that the medication time has come.

For example, a medication management case includes a plurality of lidded chambers for storing medicines, a medication instruction LED indicating the chamber having the medicine to be taken stored therein, and a display on which the present time and the medication condition are displayed (see, for example, Japanese Patent Laying-Open No. 2004-181137 [0034]-[0038], FIG. 1, FIG. 2 (Patent Document 1)).

Furthermore, an administration system is configured with a hospital-side apparatus and an at-home patient-side apparatus. The at-home patient-side apparatus includes a drug box having means for storing each divided medicine, means for displaying which drug to be taken out, and means for detecting taking in/out of drugs, and a patient terminal controller receiving and storing administration management data to let the patient know the designated time and the like, and a display portion for output and display for the patient (see, for example, Japanese Patent Laying-Open No. 10-201827 (Patent Document 2)).

In addition, a drug collection container includes a doughnut-shaped container body having a plurality of storage compartments, a controller body embedded in a central empty portion of the container body, and a bottom cover attached to the bottom portion of the container body (see, for example, Japanese Patent Laying-Open No. 2002-291840 (Patent Document 3)).

In addition, a drug container includes a container body having a plurality of compartments, a top cover fitted in the container body, and a bottom cover attached to the bottom portion of the container body (see, for example, Japanese Patent Laying-Open No. 2002-362652 (Patent Document 4)).

Patent Document 1: Japanese Patent Laying-Open No. 2004-181137

Patent Document 2: Japanese Patent Laying-Open No. 10-201827

Patent Document 3: Japanese Patent Laying-Open No. 2002-291840

Patent Document 4: Japanese Patent Laying-Open No. 2002-362652

DISCLOSURE OF THE INVENTION

Problems to be Solved by the Invention

However, in any of the disclosures in the aforementioned Patent Documents 1-4, a drug storage portion and a management function portion are integral. Thus, when drugs are to be handed to a user on an instruction from a doctor or the like, the user has to bring the entire apparatus including the drug storage portion to the hospital to have prescription medicines put into the drug storage portion.

In other words, the user is burdened with cumbersome tasks to bring the considerably heavy and bulky apparatus, have prescription medicines put in the drug storage portion at the hospital, and then bring the apparatus back home, every time drugs are administered. Moreover, the apparatus may receive vibration or shock when the apparatus is being carried, which is undesirable in terms of a stable operation of the apparatus.

The present invention is therefore made in view of the foregoing problems, and an object of the present invention is to provide a medication managing apparatus allowing drugs to be given and received to/from a user and a hospital (doctor) without causing trouble to the user.

Means for Solving the Problems

In order to solve the aforementioned object, a medication managing apparatus according to the present invention includes: a medicine package case storing a medicine package containing a medicine to be taken by a user; and a main body unit removably storing the medicine package case.

The medication managing apparatus is configured such that the medicine package case is removably attached to the main body unit.

Alternatively, as more specific configuration, a medication managing apparatus according to the present invention includes: a medicine package case; and a main body unit removably storing the medicine package case, and managing medication-related information including a medication instruction time, to give, at the medication instruction time, an instruction/notice of medication. The medicine package case includes a plurality of blocks divided by walls and arranged in parallel with each other, each storing a medicine package containing a medicine to be taken by a user, and an openable/closable cover covering the plurality of blocks to allow the medicine package to be stored and taken out. The main body unit includes a medicine package sensor sensing the medicine package in each block, and a medicine package case sensor sensing attachment/removal of the medicine package case to/from the main body unit.

The medication managing apparatus is configured such that the medicine package case is removably attached to the main body unit, and that the main body unit senses attachment/removal of the medicine package case by the medicine case sensor.

Preferably, the medication managing apparatus includes openings provided at opposing walls of the each block and formed at positions facing each other such that the medicine package stored in the block is sandwiched therebetween. The medicine package sensor is disposed corresponding to each opening at the opposing walls of each block, to sense a medicine package based on that the medicine package stored in the block blocks a gap between a pair of openings.

Preferably, the medication managing apparatus includes a cover opening/closing sensor sensing opening/closing of the cover of the medicine package case.

Preferably, the medication managing apparatus includes: information storing means for storing said medication-related information; and notice means for giving, at said medication instruction time, a notice that said medication instruction time has come.

In this case, suitably, the information storing means is a storage medium externally attached to the main body unit, and the medication managing apparatus includes a storage medium attachment portion for attaching the storage medium.

Furthermore, preferably, the medication managing apparatus includes medication condition management means for causing the medication-related information to be stored in the storage medium based on the medication instruction time and a detection signal of the medicine package sensor, the medicine package case sensor and the cover opening/closing sensor.

On the other hand, preferably, the blocks of the medicine package case are arranged in the depth direction of the main body unit, each positioned orthogonally to the depth direction of main body unit.

Preferably, a notch portion is provided at the opposing wall of each block to extend downwardly from an upper edge of the wall.

In the present invention, the medicine contained in the medicine package includes a powder medicine, a tablet medicine, or a combination of them.

Effects of the Invention

According to the present invention, the following effects are achieved.

(1) When drugs are handed to the user under an instruction from a doctor or the like, the user need only bring only a medicine package case removed from the main body unit to the hospital so that the drugs can be given/received to/from the user and the hospital (doctor) without causing much trouble to the user.

(2) It is not necessary to carry the main body unit including a management function portion such as a medicine package sensor and a medicine package case sensor, thereby ensuring a stable operation of the apparatus.

(3) According to the invention recited in claim 1, the medicine package in each block can be sensed with a simple configuration.

(4) According to the invention recited in claim 2, it is easily managed whether not only the user but also somebody else opens the cover of the medicine package case.

(5) According to the invention recited in claim 3, the user can readily be aware of the medication instruction time and no longer forgets the medication on the instruction time.

(6) According to the invention recited in claim 4, the medication-related information such as the medication instruction time can easily be managed, and the costs therefor is cheap.

(7) According to the invention recited in claim 5, the medication-related information can easily be managed, such as whether medicine is taken on the instruction time, whether the medicine package case is removed from the main body unit, and whether the cover of the medicine package case is opened.

(8) According to the invention recited in claim 6, the medicine package stored in each block of the medicine package case can readily be visually recognized, and a medicine package can easily be put into each block and taken out from each block.

(9) According to the invention recited in claim 7, the medicine package can readily be taken out from each block of the medicine package case.

DESCRIPTION OF THE REFERENCE SIGNS

Figure 1:
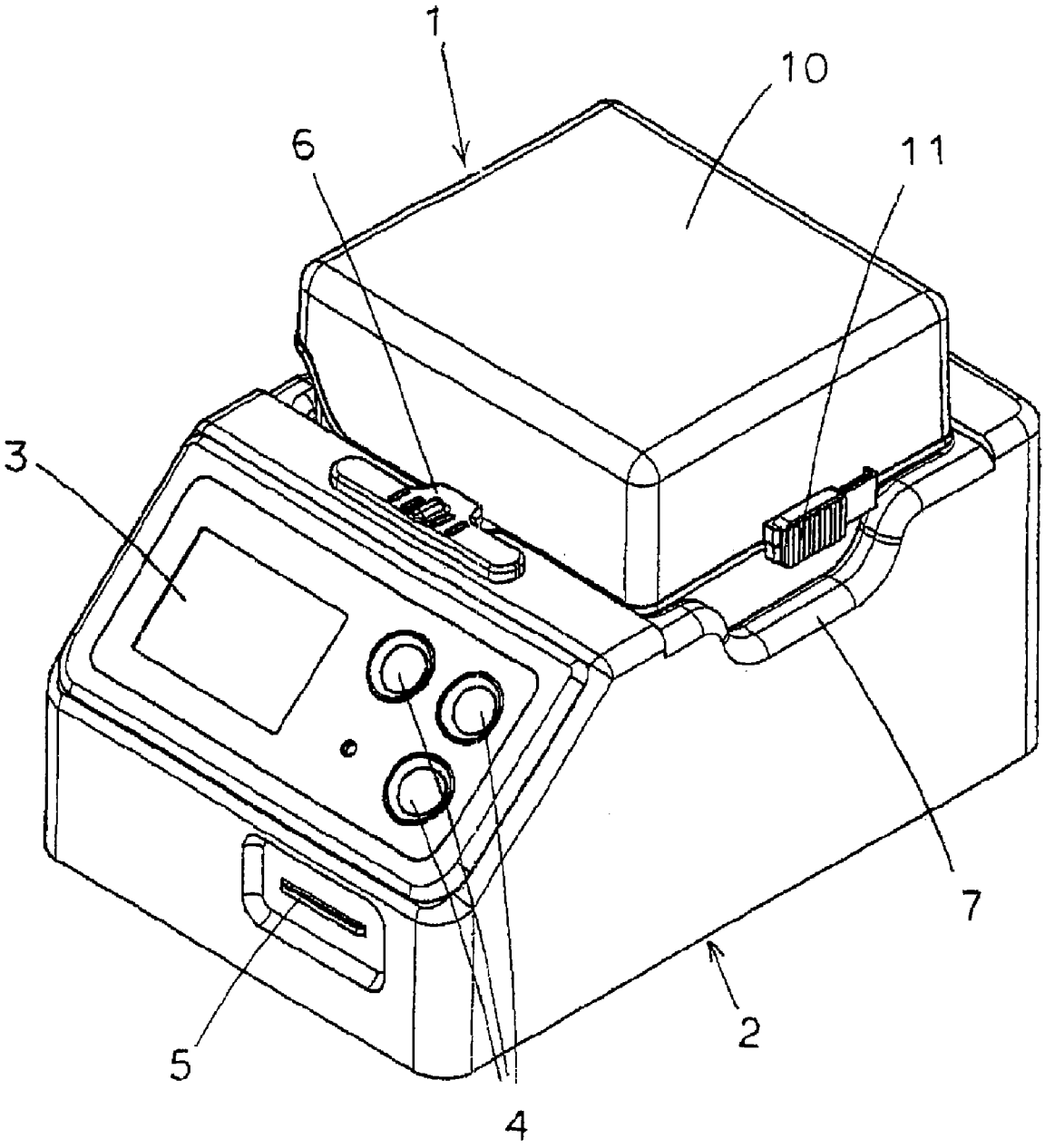
FIG. 1 is an external perspective view of a medication managing apparatus in accordance with an embodiment.
Figure 2:
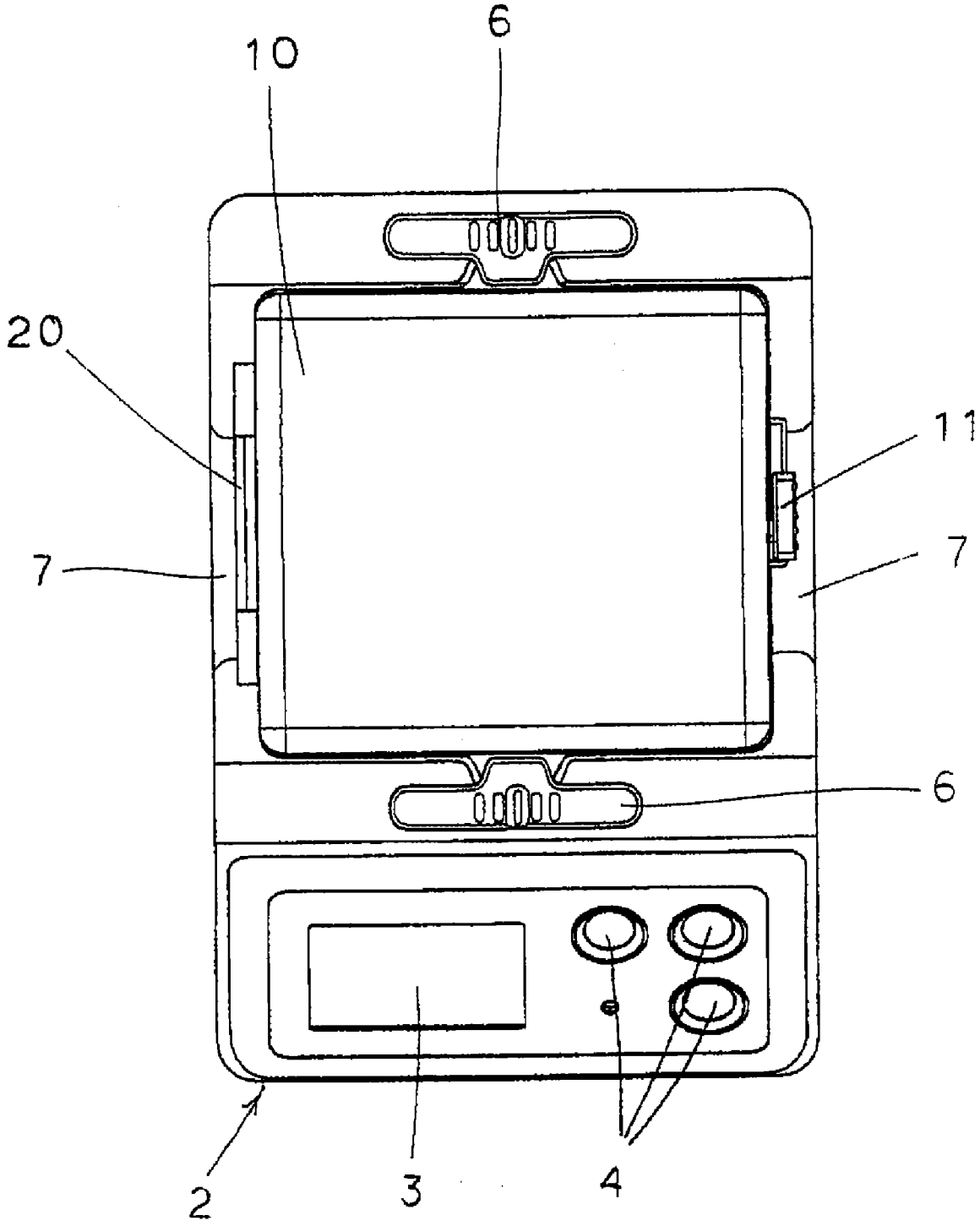
FIG. 2 is a plan view (top view) of the medication managing apparatus.
Figure 3:
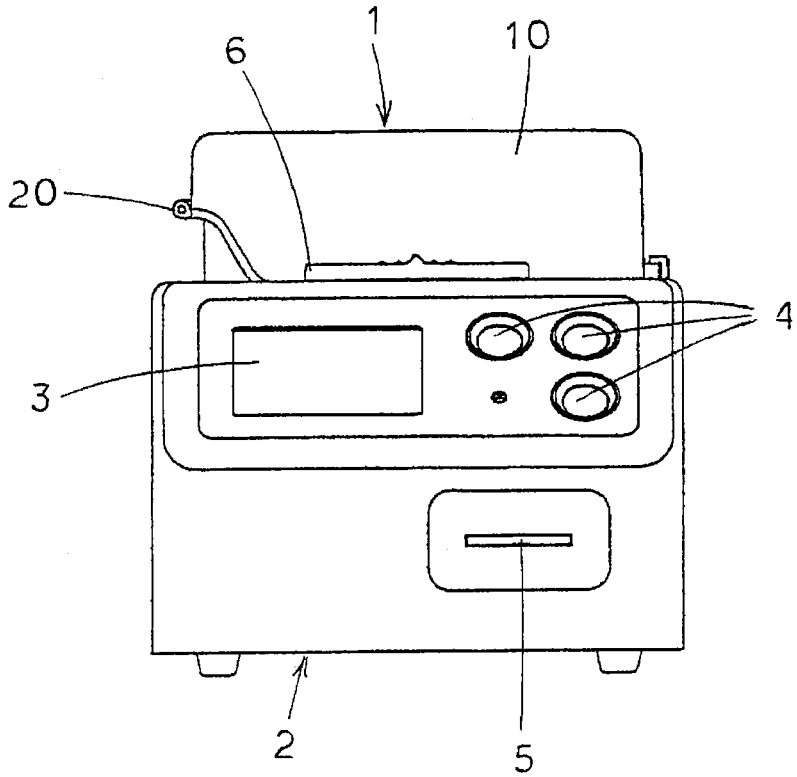
FIG. 3 is a front view of the medication managing apparatus.
Figure 4:
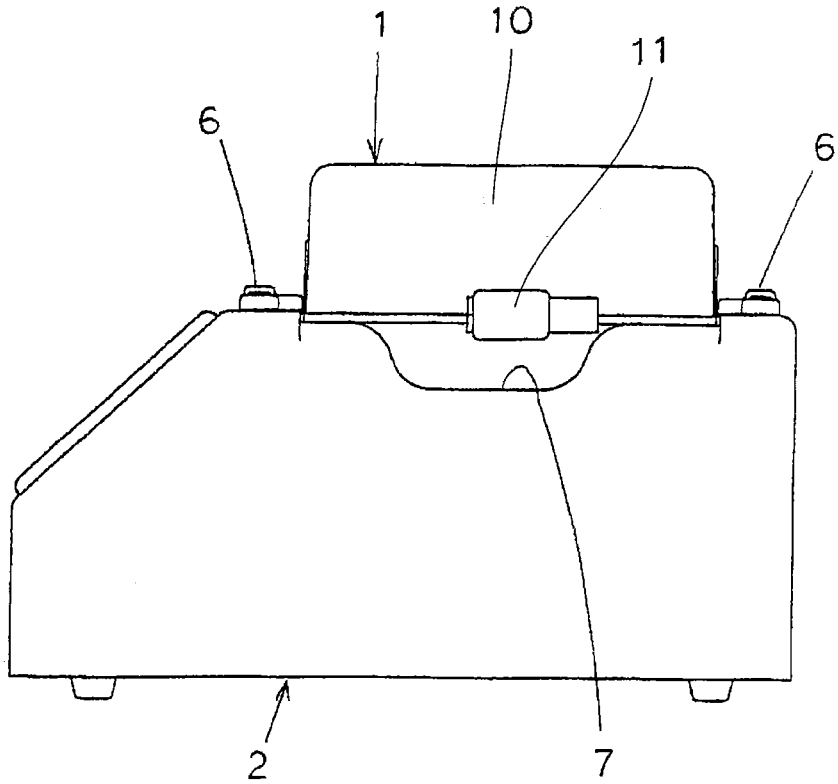
FIG. 4 is a right-side view of the medication managing apparatus.
Figure 5:
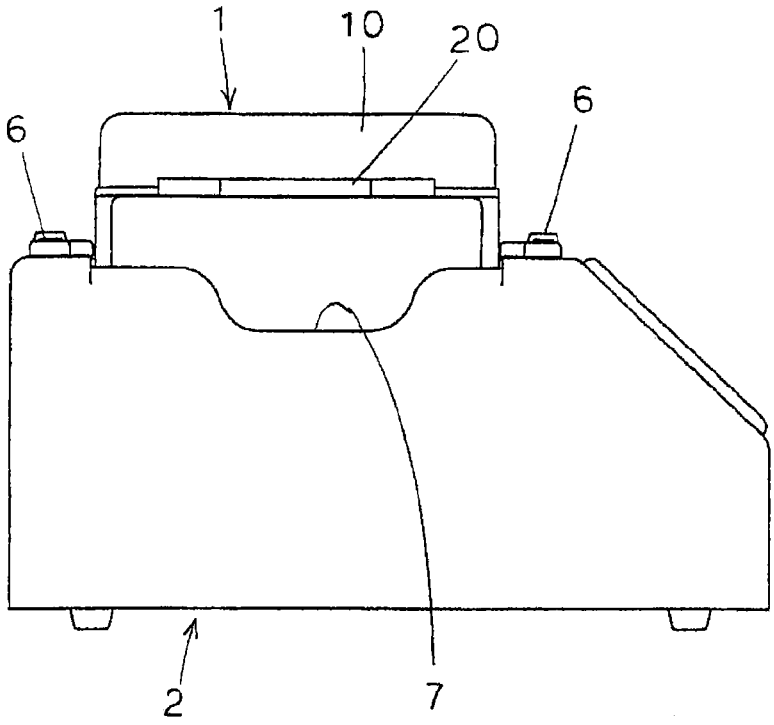
FIG. 5 is a left-side view of the medication managing apparatus.
Figure 6:
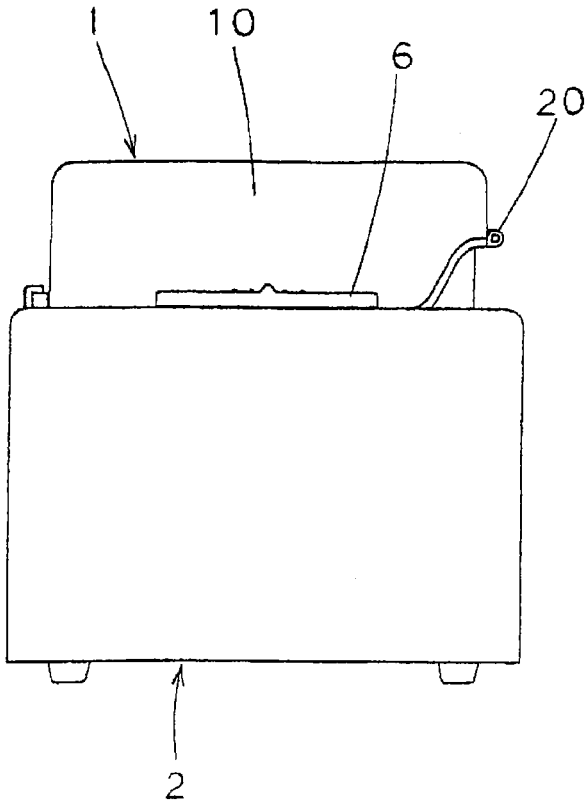
FIG. 6 is a rear view of the medication managing apparatus.
Figure 7:
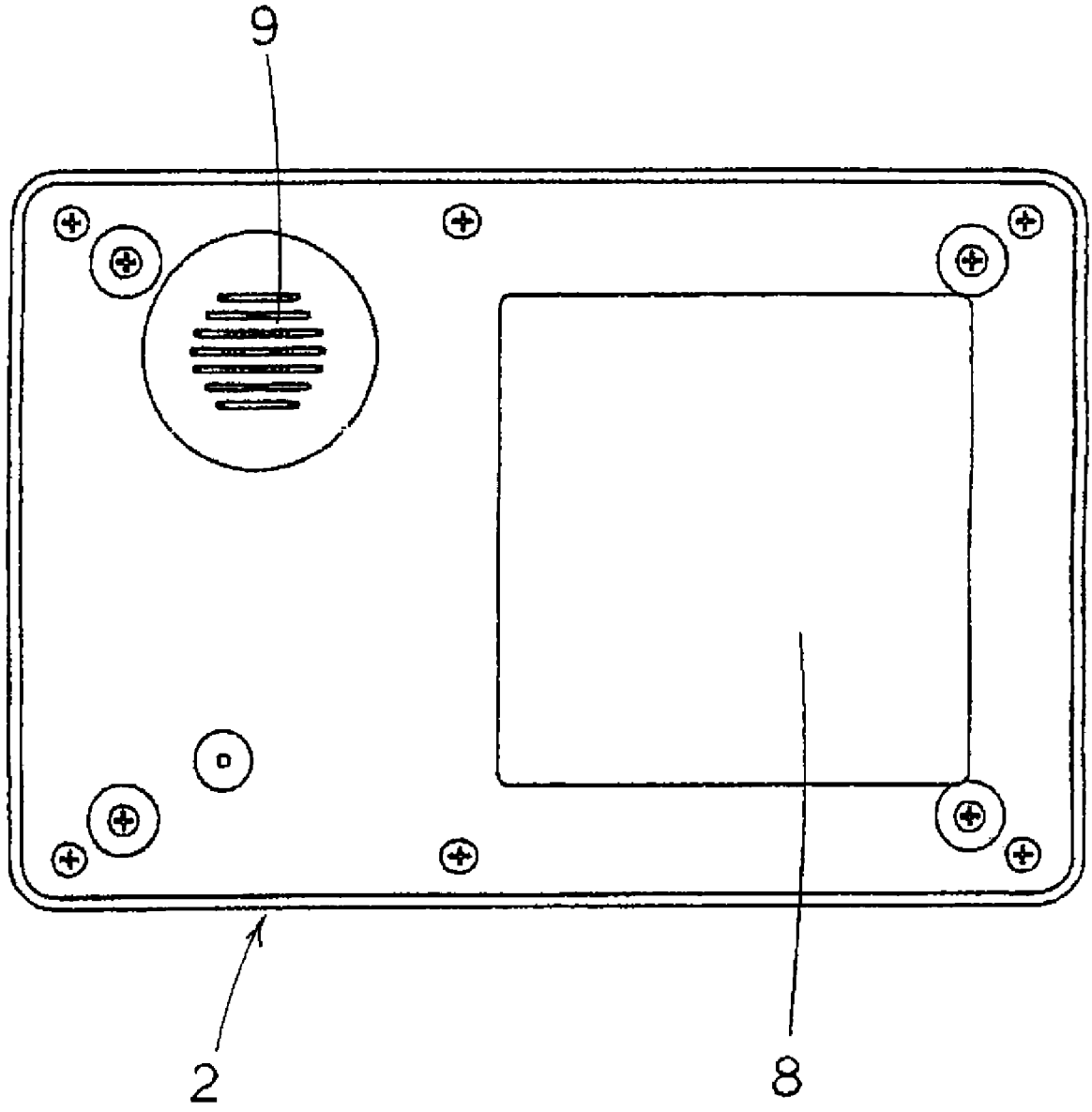
FIG. 7 is a bottom view of the medication managing apparatus.

1 medicine package case, 2 main body unit, 5 slot (storage medium attachment portion), 9 speaker (notice means), 10 cover, 12*a*-12*g* block, 13 wall, 15 opening, 16 support piece, 17 notch portion, 30 storage portion, 35 switch lever (medicine package case sensor), 36 micro-switch (medicine package case sensor), 45, 112 SD card (storage medium), 51-57 medicine package, T1-T9 projection portion, S1-S7 sensor portion (medicine package sensor), L1-L7 light-emitting diode, D1-D7 photodiode, 101 CPU, 102 operation input portion, 103 setting recording portion, 104 display portion, 105 voice output portion, 106 clock portion, 107 recording medium attachment portion, 108 medicine package case sense portion, 109 case cover opening/closing sense portion, 110 medicine package sense portion, 111 power supply portion.

BEST MODES FOR CARRYING OUT THE INVENTION

In the following, the present invention will be described based on an embodiment.

FIG. 1, FIG. 2, FIG. 3, FIG. 4, FIG. 5, FIG. 6, and FIG. 7 respectively show an external perspective view, a plan view (top view), a front view, a right-side view, a left-side view, a rear view and a bottom view of a medication managing apparatus in accordance with the embodiment.

The medication managing apparatus includes a medicine package case 1 and a main body unit 2 removably storing medicine package case 1 and managing medication-related information including a medication instruction time to give an instruction/notice of medication when the medication instruction time comes.

Medicine package case 1 includes an openable/closable cover 10 and a slide knob 11 for fixing/releasing the closed state of cover 10.

Main body unit 2 includes a display portion (LCD) 3 displaying information such as time, medication instruction time, and medication history, a button 4 for turning on/off the power, setting the time and switching display, and a slot (storage medium attachment portion) 5 for attaching, for example, an SD card 45 (storage medium, see FIG. 23) as information storing means for storing medication-related information including the medication instruction time.

Provided on the top of main body unit 2 is a pair of slide knobs 6 for fixing/releasing the storage state of medicine package case 1 in main body unit 2. In a click position of slide knob 6, medicine package case 1 is fixed so that it is not easily detached from main body unit 2. In addition, a pair of notch portions 7 are formed on the top of main body unit 2 to facilitate removal of medicine package case 1 from main body unit 2.

On the other hand, a battery cover 8 is removably mounted on the bottom of main body unit 2, so that a battery as a power supply can easily be put in/taken out by removing battery cover 8. Here, AC may be used alone or in combination as a power supply. In this case, an insertion slot having an AC code connected thereto is provided at an appropriate place of main body unit 2. In addition, a speaker 9 is provided as notice means for giving, at the medication instruction time, a notice that the medication instruction time has come.

Figure 8:
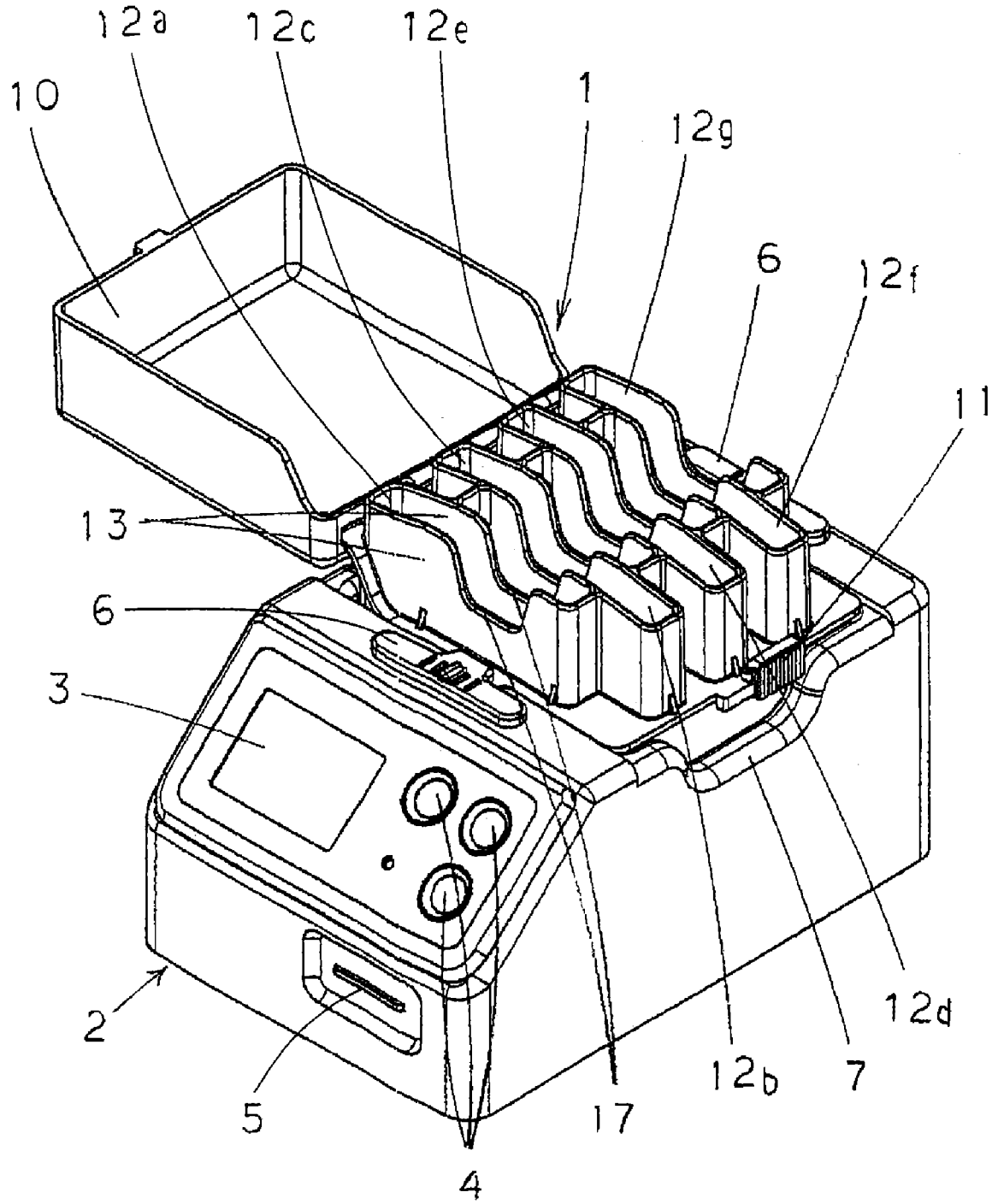
FIG. 8 is an external perspective view in which a cover of a medicine package case of the medication managing apparatus is opened.
Figure 9:
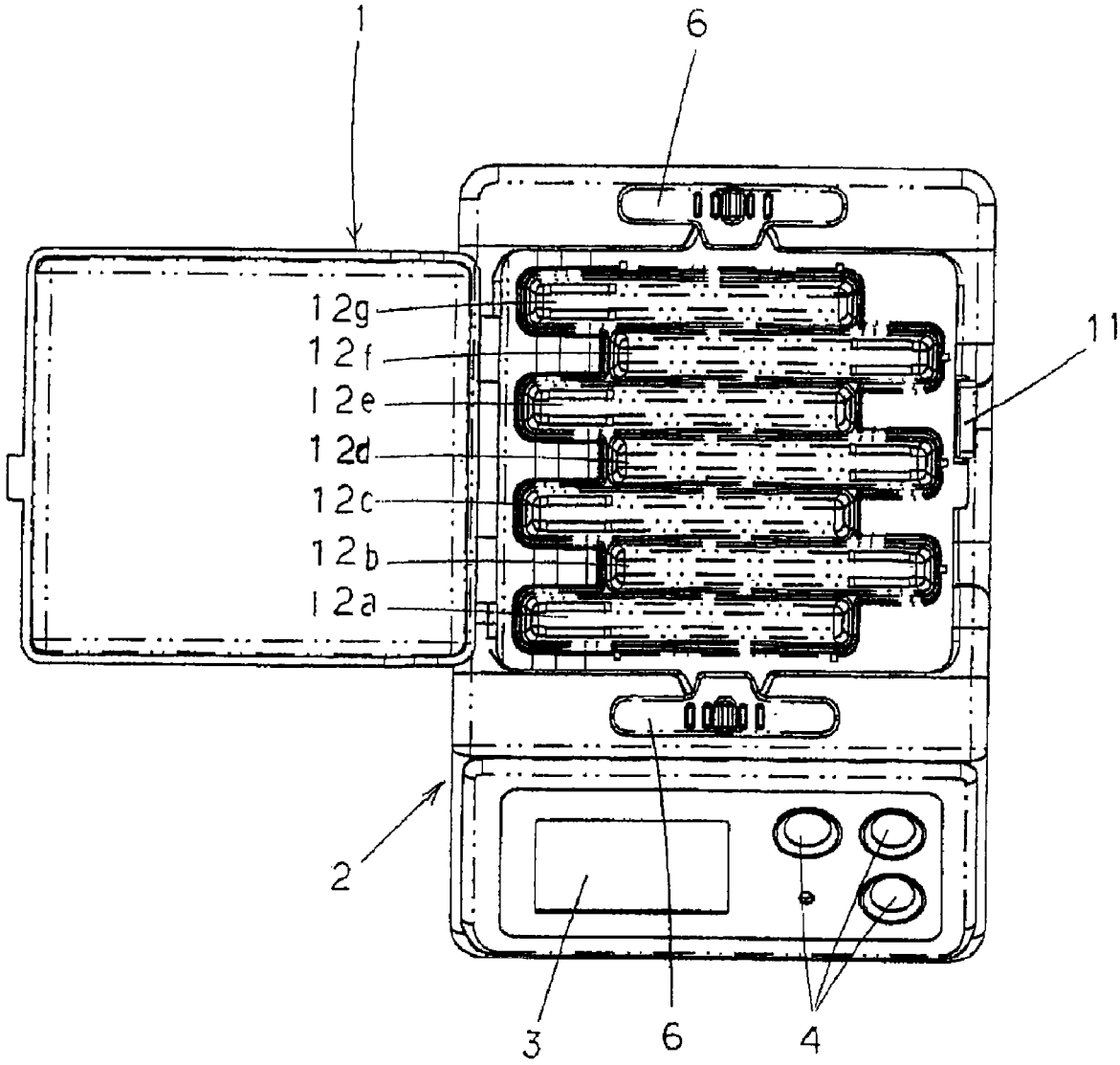
FIG. 9 is a plan view (top view) in which the cover of the medicine package case of the medication managing apparatus is opened.
Figure 10:
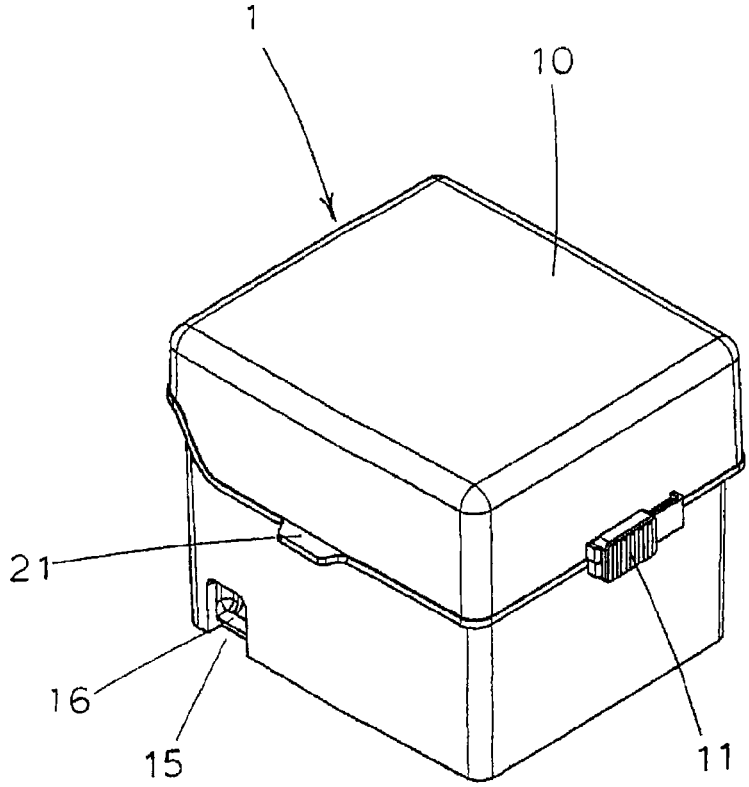
FIG. 10 is an external perspective view of the medicine package case in the medication managing apparatus as viewed from the front side.
Figure 11:
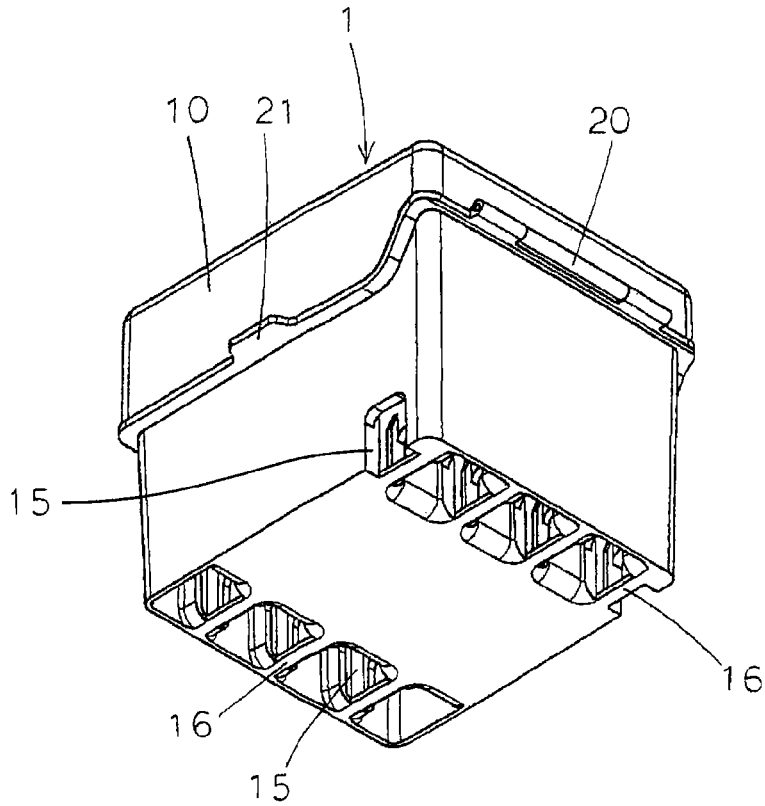
FIG. 11 is an external perspective view of the medicine package case in the medication managing apparatus as viewed from the back side.
Figure 12A:
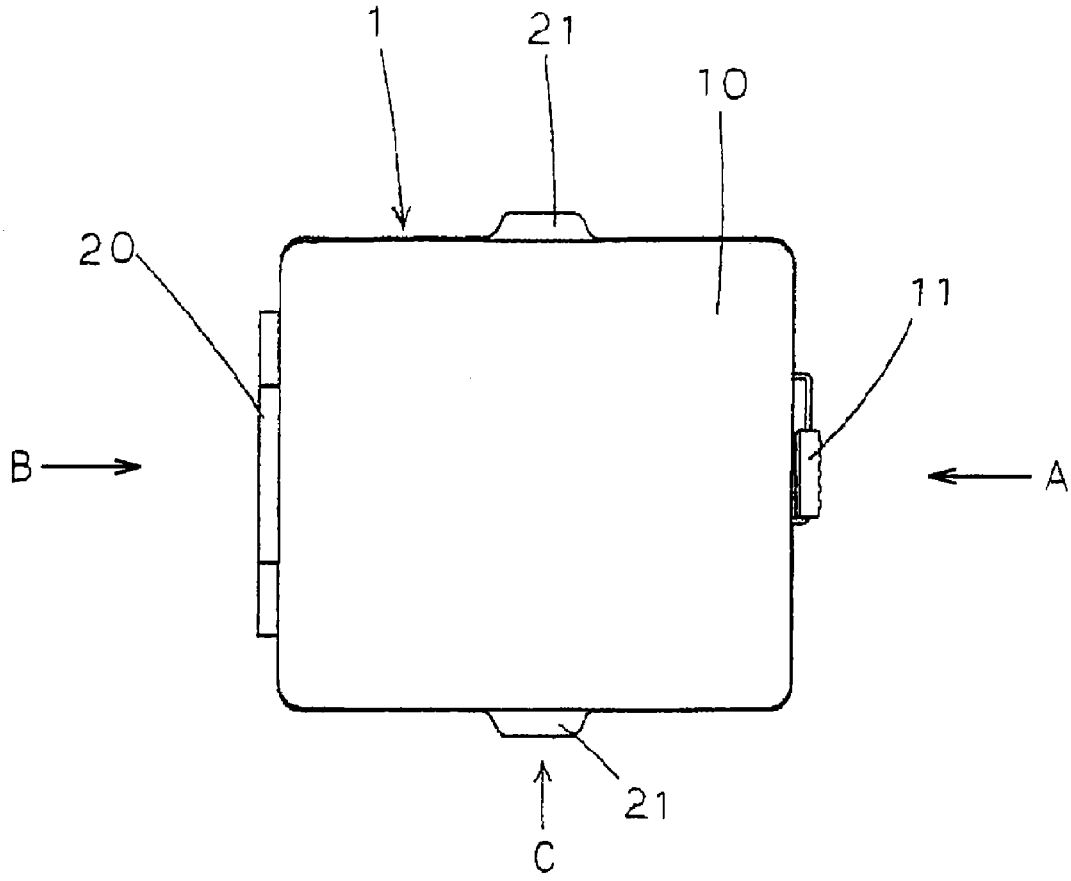
FIG. 12A is a plan view (top view) of the medicine package case in the medication managing apparatus.
Figure 12B:
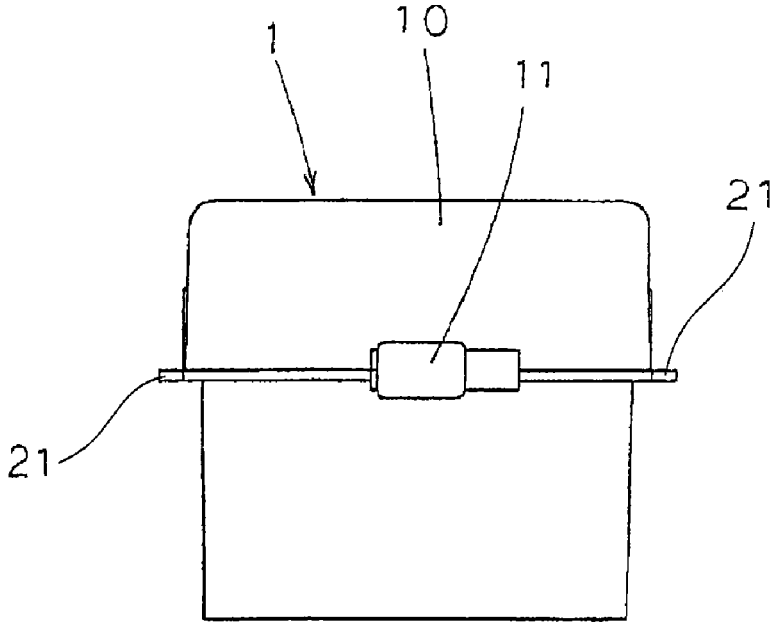
FIG. 12B is a view (front view) of the medicine package case in the medication managing apparatus as viewed from arrow A in FIG. 12A.
Figure 13A:
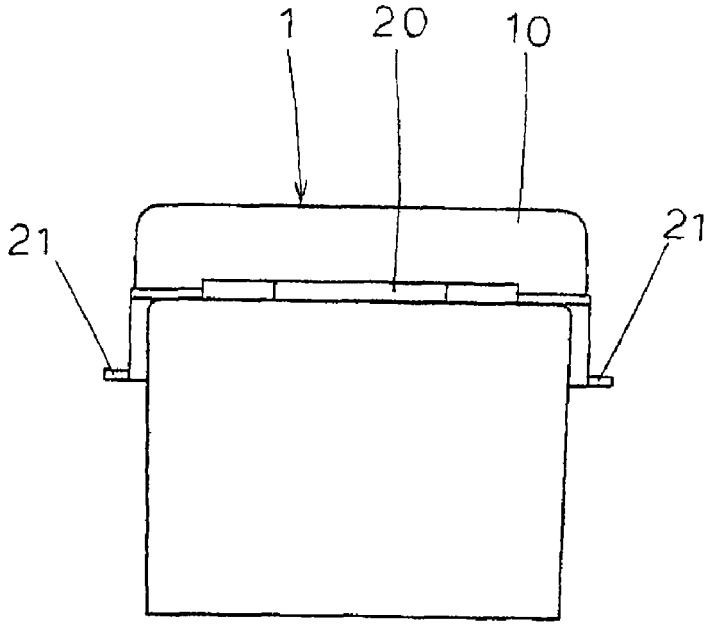
FIG. 13A is a view (rear view) of the medicine package case in the medication managing apparatus as viewed from arrow B in FIG. 12A.
Figure 13B:
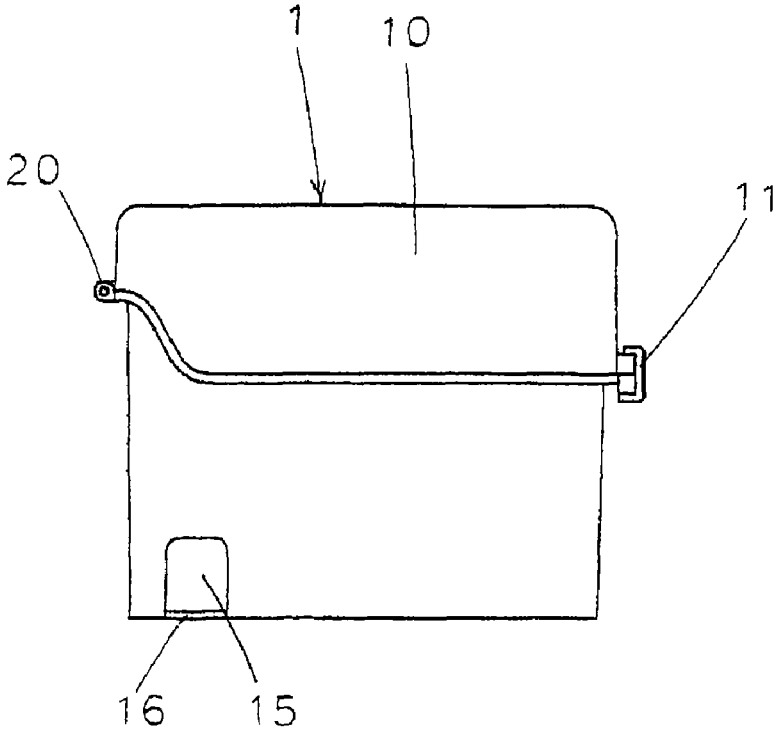
FIG. 13B is a view (left-side view) of the medicine package case in the medication managing apparatus as viewed from arrow C in FIG. 12A.
Figure 14:
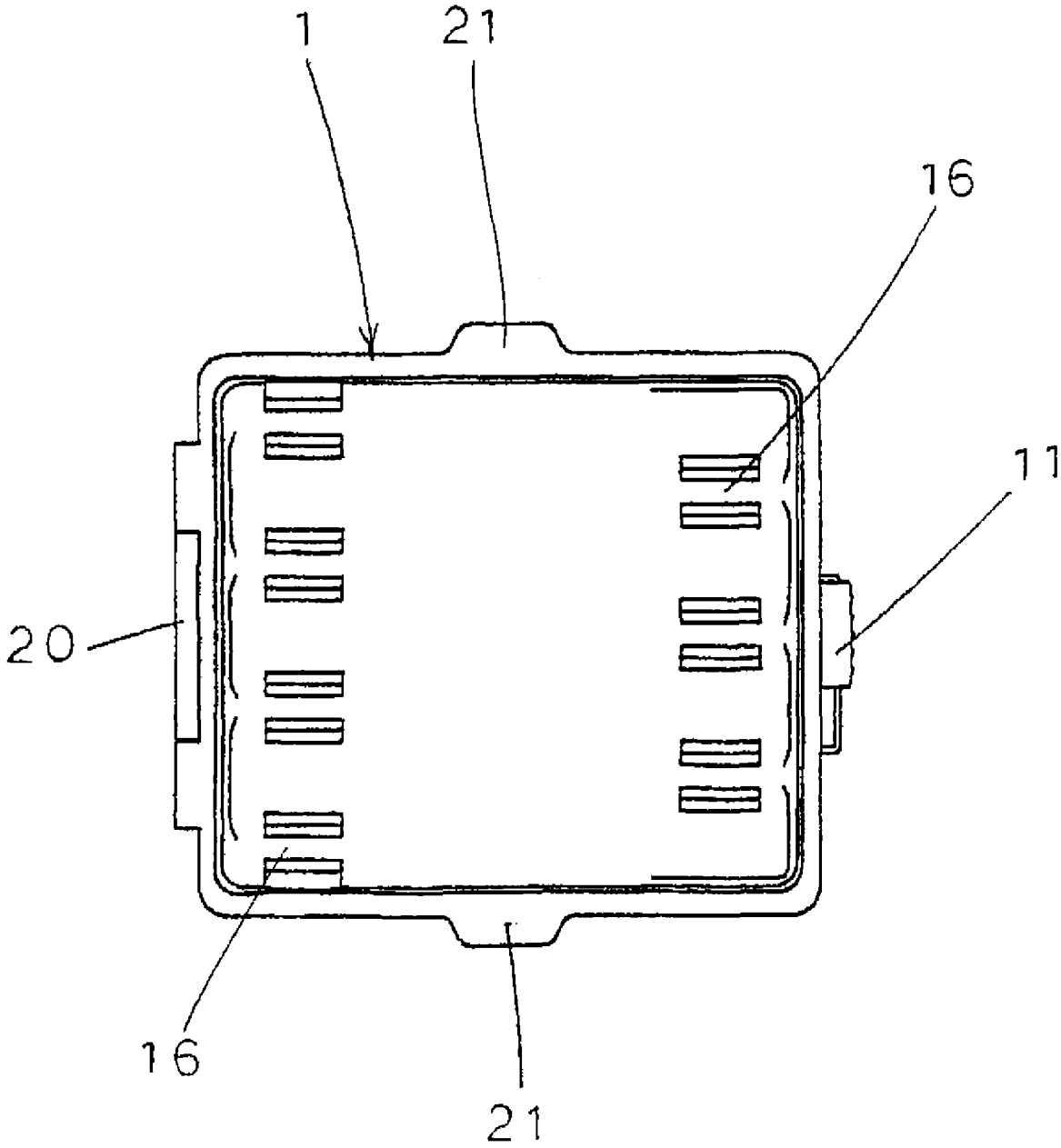
FIG. 14 is a bottom view of the medicine package case in the medication managing apparatus.
Figure 15:
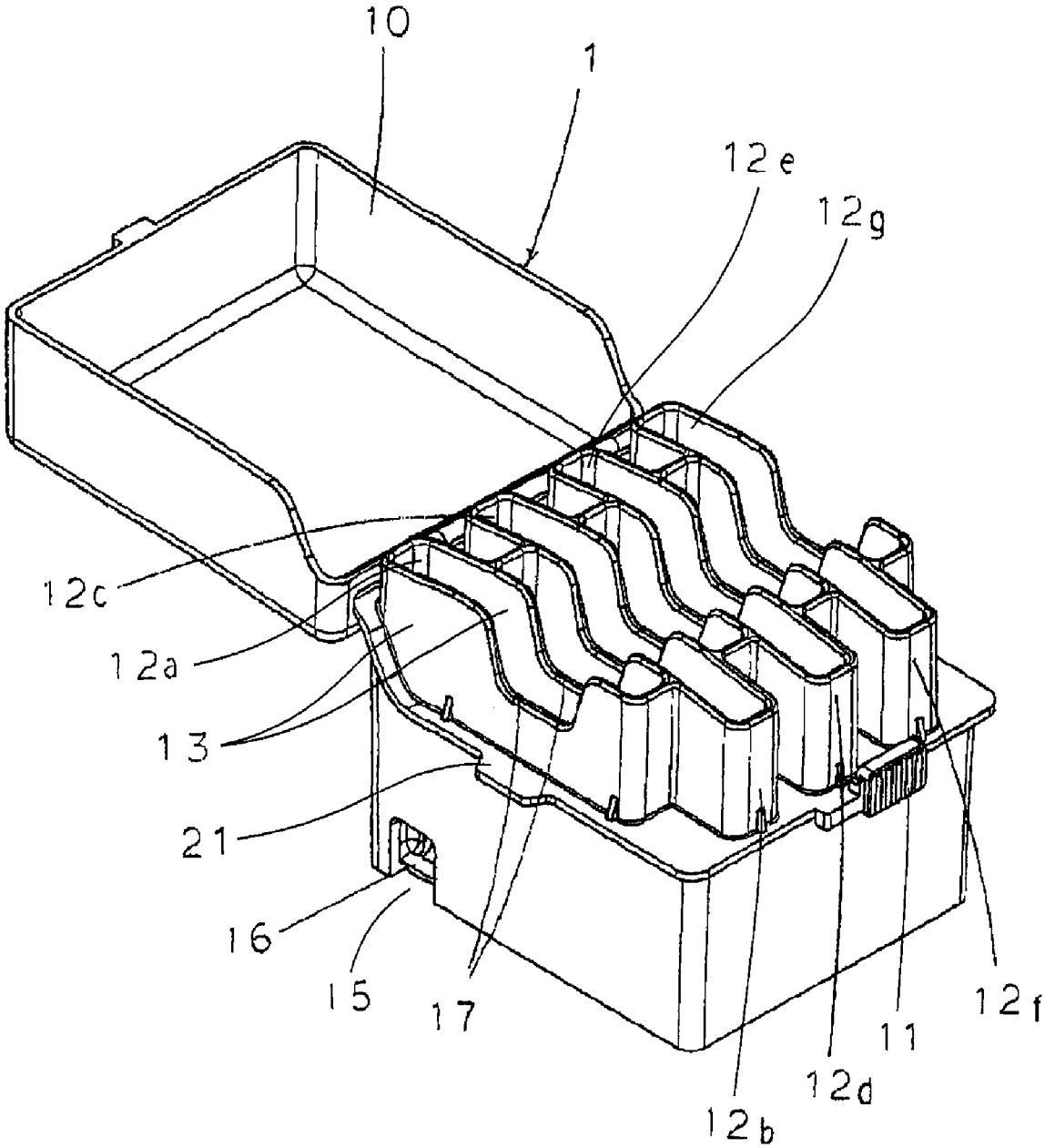
FIG. 15 is an external perspective view in which the cover of the medicine package case is opened in the medication managing apparatus.
Figure 16:
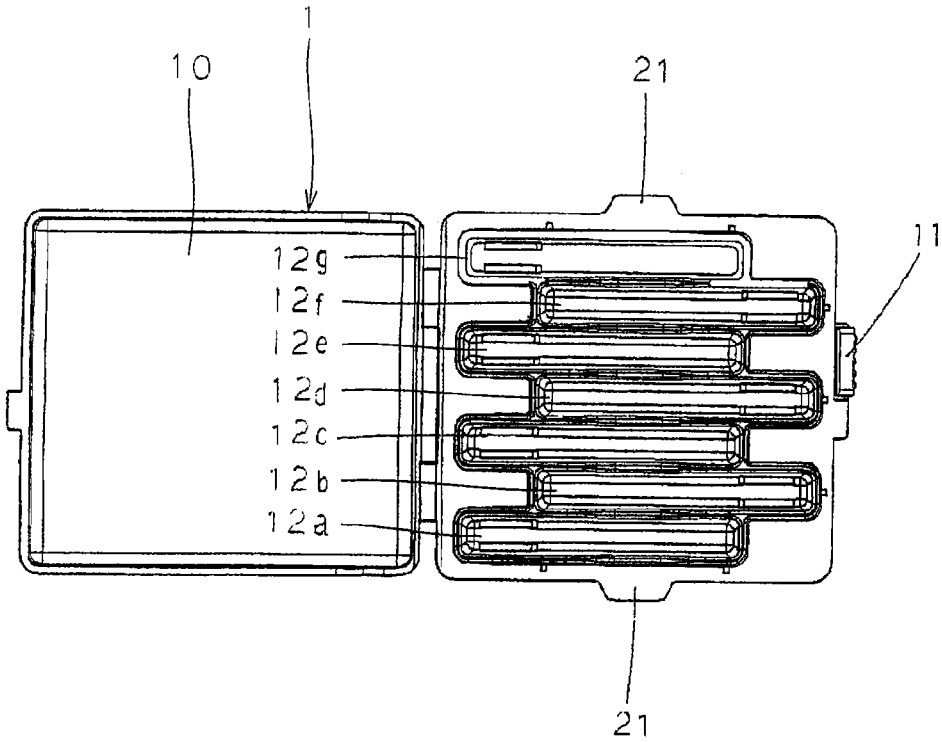
FIG. 16 is a plan view (top view) in which the cover of the medicine package case is opened in the medication managing apparatus.
Figure 17:
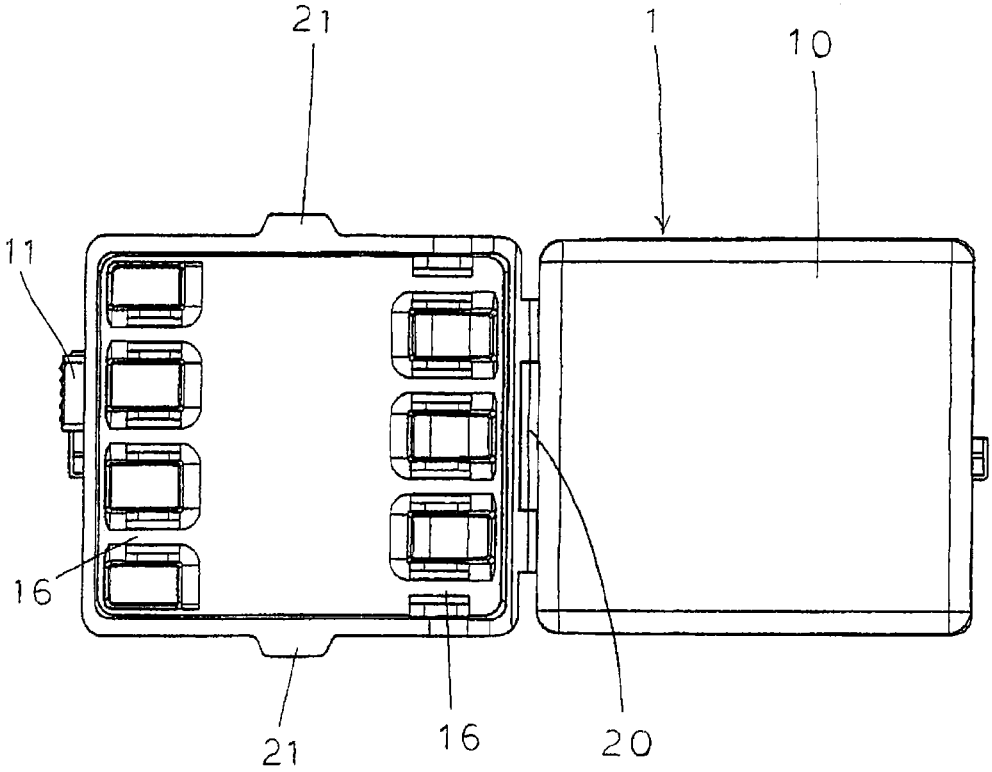
FIG. 17 is a bottom view in which the cover of the medicine package case is opened in the medication managing apparatus.

In this medication managing apparatus, FIG. 8 and FIG. 9 respectively show an external perspective view and a plan view (top view) in which cover 10 of medicine package case 1 is opened. FIG. 10 and FIG. 11 respectively show an external perspective view of medicine package case 1 as viewed from the front side and the back side. FIG. 12A shows a plan view (top view), FIG. 12B shows a view (front view) as viewed from arrow A in FIG. 12A, FIG. 13A shows a view (rear view) as viewed from arrow B in FIG. 12A, FIG. 13B shows a view (left-side view) as viewed from arrow C in FIG. 12A, and FIG. 14 shows a bottom view of medicine package case 1. FIG. 15, FIG. 16 and FIG. 17 respectively show an external perspective view, a plan view (top view) and a bottom view in which cover 10 is opened.

Medicine package case 1 has cover 10 coupled thereto with a shaft portion 20 in an openable/closable manner and has a plurality (here, seven) of blocks 12*a*-12*g* each storing a medicine package (not shown) containing a medicine to be taken by a user. As is clear from the drawings, blocks 12*a*-12*g* are provided in parallel with each other in the depth direction, each positioned orthogonally to the depth direction of main body unit 2, and are arranged to be alternately displaced in the orthogonal direction. Blocks 12*a*-12*g* are each divided by a pair of opposing walls (FIG. 8, FIG. 15) 13, and wall 13 which divides the adjacent blocks is shared by these blocks.

At the lower portion of each wall 13 forming each block 12*a*-12*g*, openings 15 are formed to face each other such that a medicine package stored in each block is sandwiched therebetween. Opening 15 reaches a support piece 16 provided on the bottom of each block 12*a*-12*g*. Here, support piece 16 is continuous on the bottom face of medicine package case 1. In addition, on the top of each wall 13 forming each block 12*a*-12*g*, a notch portion 17 is formed extending downwardly from the upper edge thereof Notch portion 17 facilitates removal of a medicine package from each block 12*a*-12*g*.

Furthermore, medicine package case 1 is provided with a pair of flanges 21 protruding from an outer wall thereof. These flanges 21 are positioned in a pair of flange reception portions 32 (FIG. 18-FIG. 20) provided on the top of main body unit 2 when medicine package case 1 is stored in main body unit 2. Moving slide knob 6 to the click position with flange 21 fit in flange reception portion 32 prevents flange 21 from being pulled off from flange reception portion 32 thereby to fix the storage state of medicine package case 1 in main body unit 2.

Figure 18:
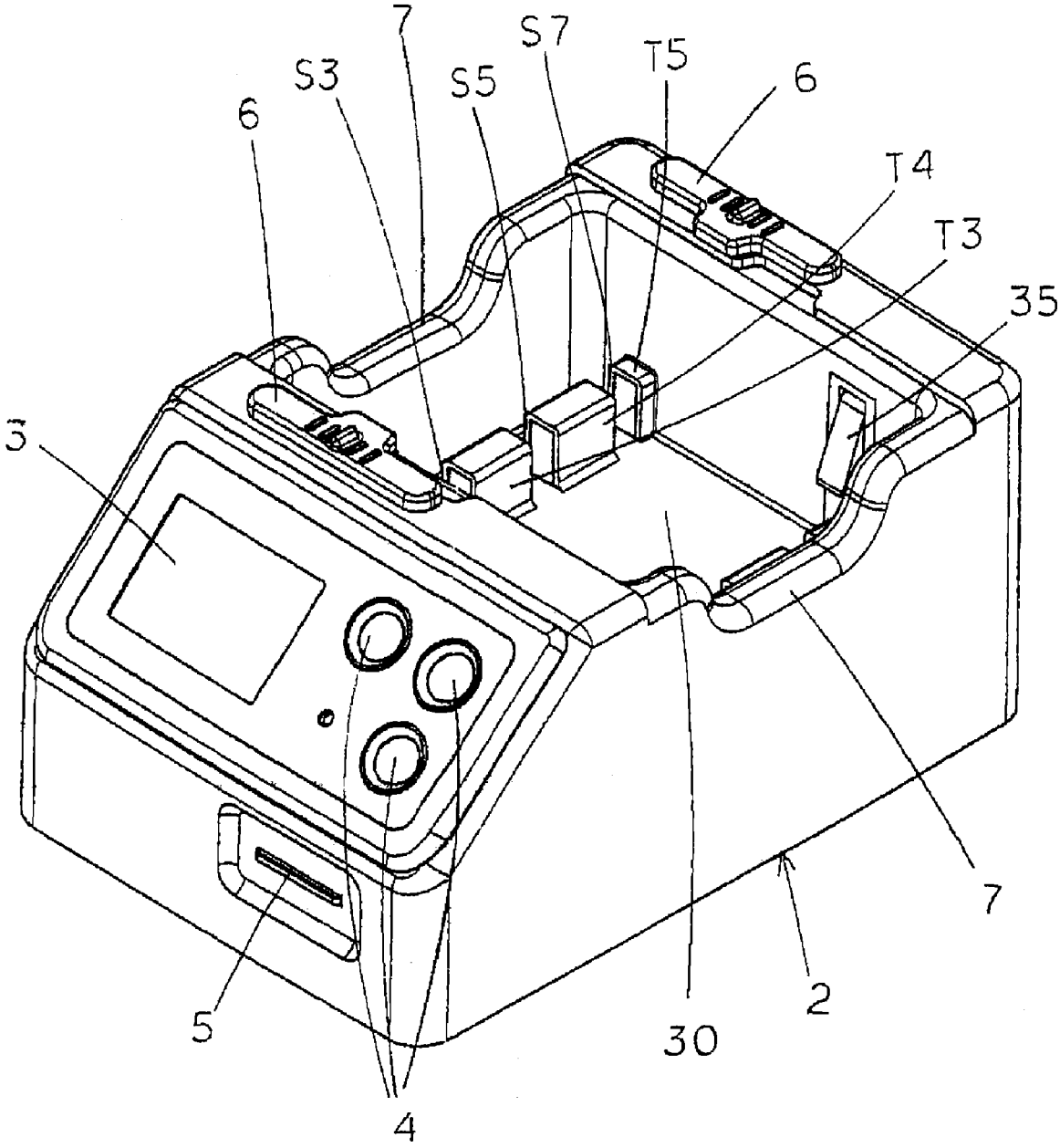
FIG. 18 is an external perspective view of a main body unit in the medication managing apparatus.
Figure 19:
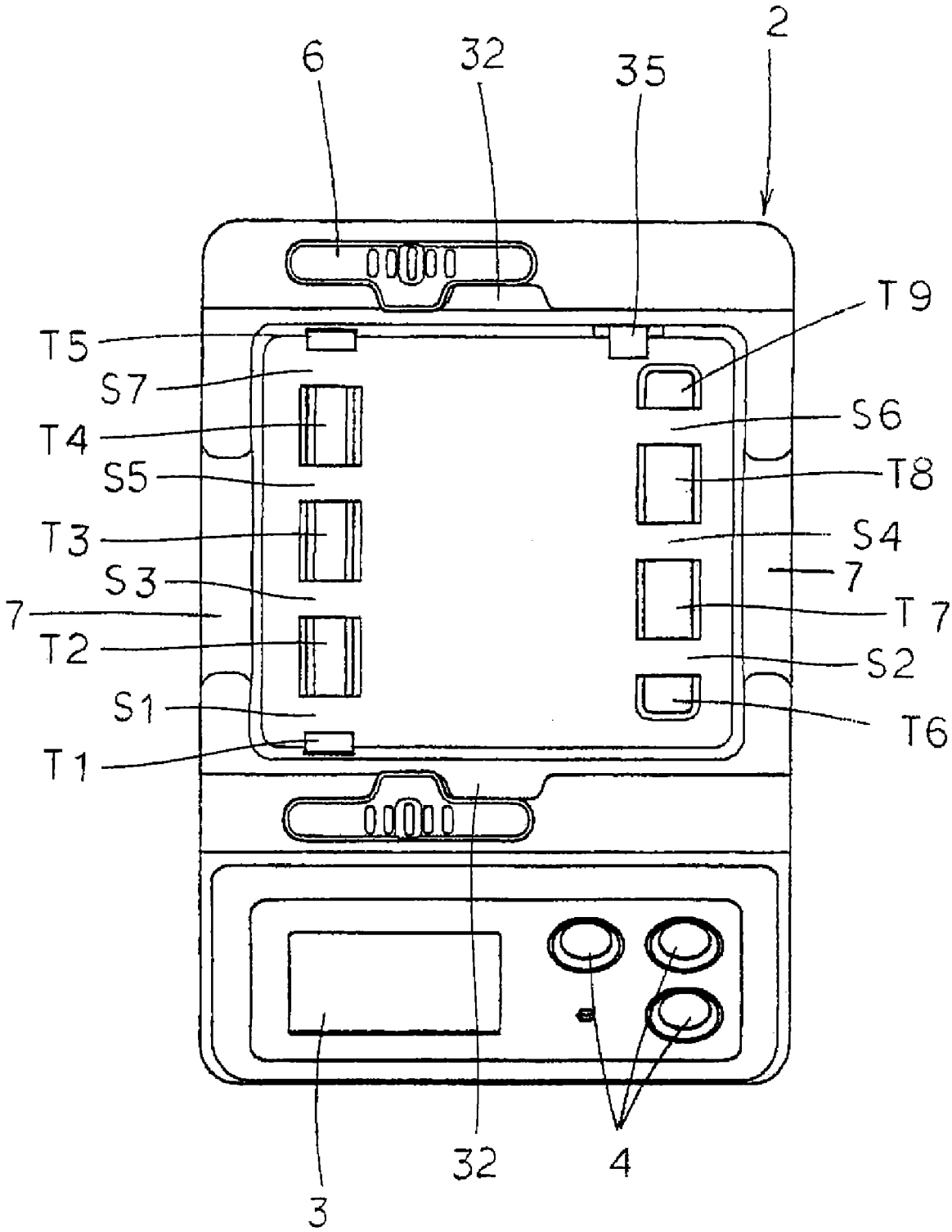
FIG. 19 is a plan view (top view) of the main body unit in the medication managing apparatus.
Figure 20:
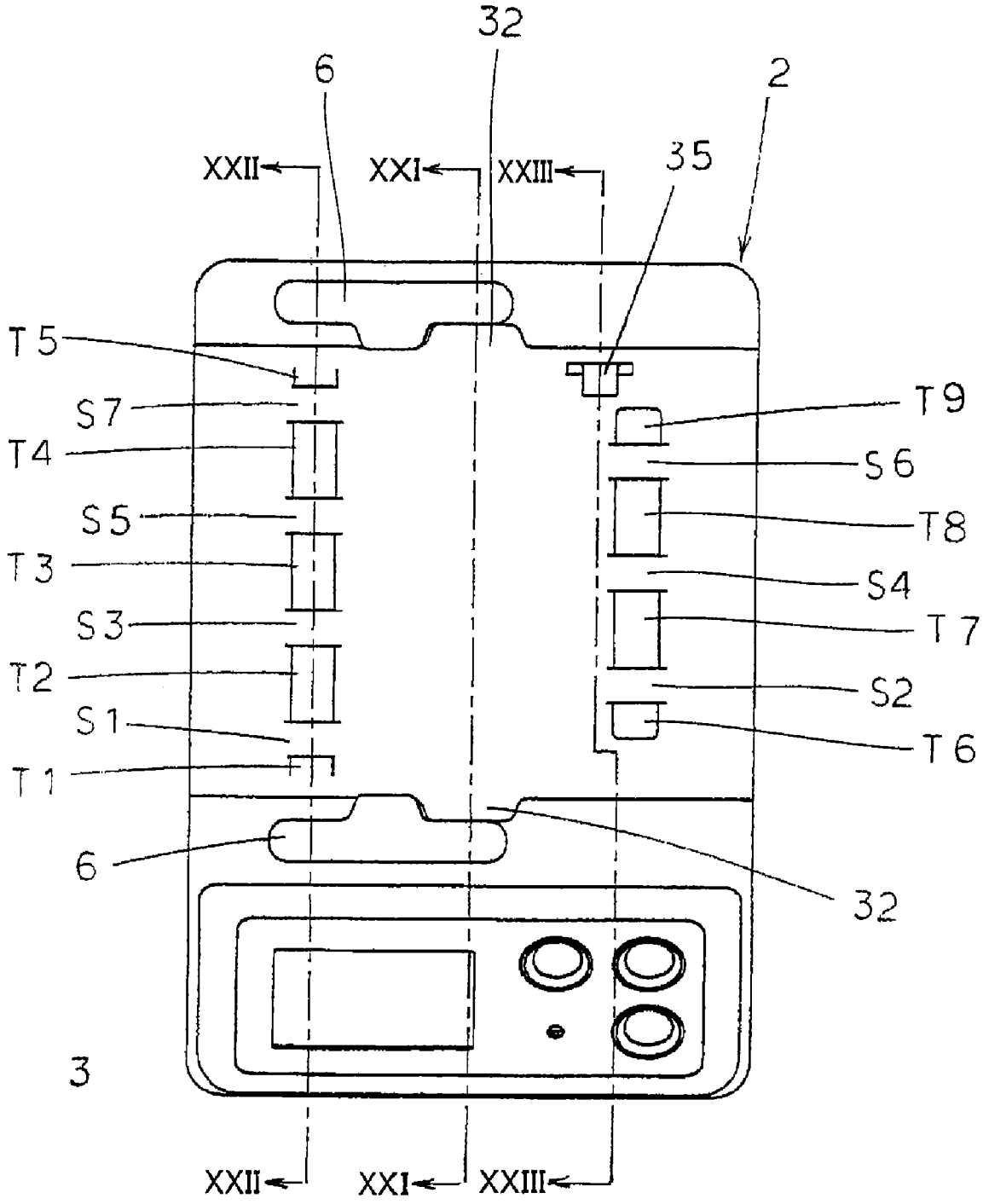
FIG. 20 is a plan view (top view) (a simplified view of FIG. 19) of the main body unit in the medication managing apparatus.
Figure 21:
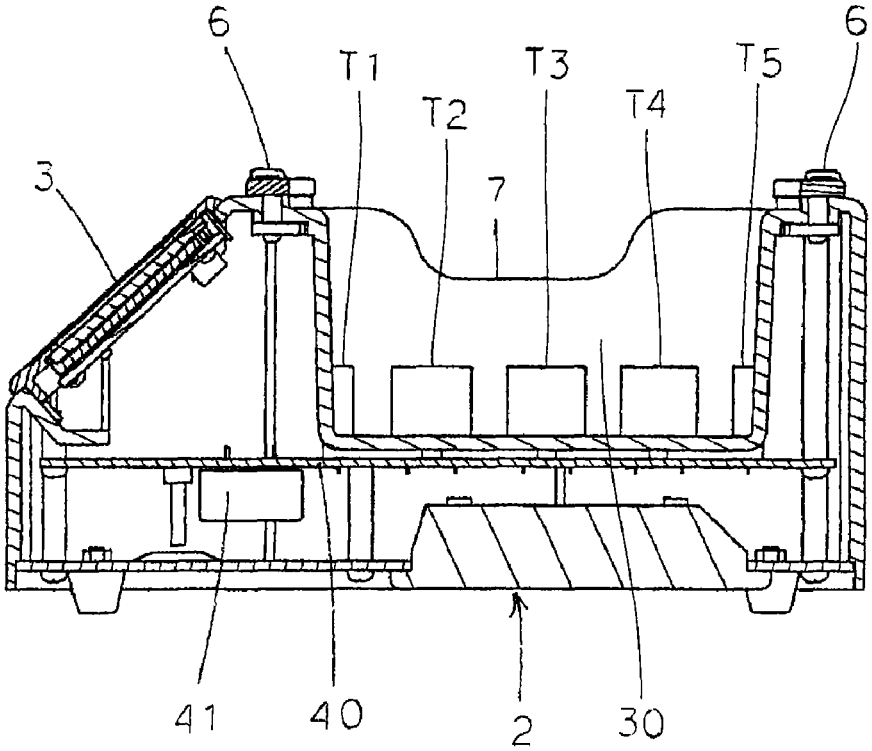
FIG. 21 is a cross-sectional view of the main body unit taken along line XXI-XXI in FIG. 20.
Figure 22:
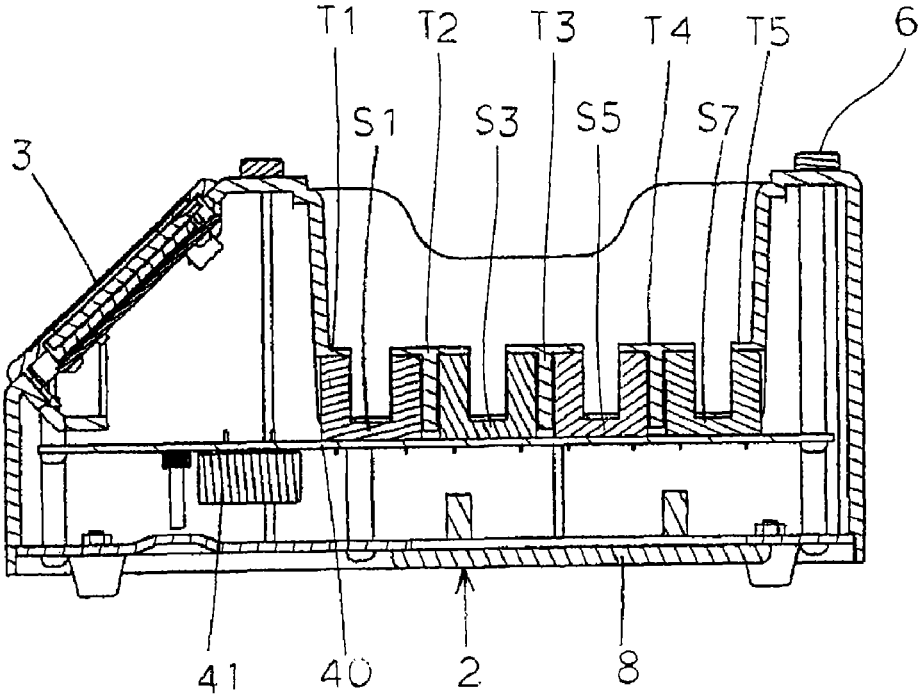
FIG. 22 is a cross-sectional view of the main body unit taken along line XXII-XXII in FIG. 20.
Figure 23:
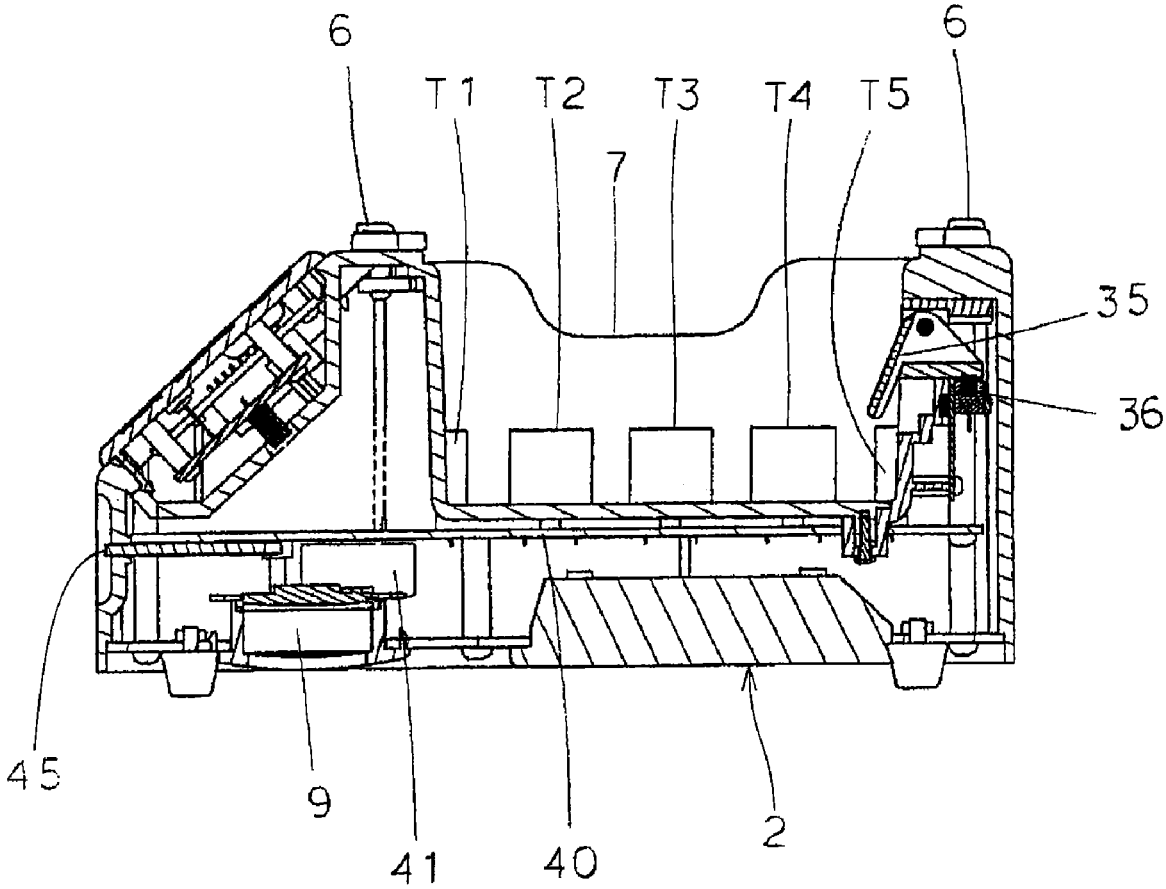
FIG. 23 is a cross-sectional view of the main body unit taken along line XXIII-XXIII in FIG. 20.

On the other hand, FIG. 18, FIG. 19 and FIG. 20 (a simplified view of FIG. 19) respectively show an external perspective view and a plan view (top view) of main body unit 2. FIG. 21 shows a cross-sectional view taken along line XXI-XXI in FIG. 20, FIG. 22 shows a cross-sectional view taken along line XXII-XXII in FIG. 20 and FIG. 23 shows a cross-sectional view taken along line XXIII-XXIII.

Main body unit 2 has a storage portion 30 for storing medicine package case 1. Nine projection portions T1-T9 are formed on the bottom of storage portion 30. Seven sensor portions S1-S7 are disposed as medicine package sensors at these projection portions T1-T9. Each of sensor portions S1-S7 uses a photocoupler including a light emitting diode L and a photodiode D. The distance between each of projection portions T1-T9 is constant.

Projection portions T1-T5 are displaced from projection portions T6-T9 in said depth direction correspondingly to blocks 12*a*-12*g* of medicine package case 1. In a state where medicine package case 1 is stored in storage portion 30 of main body unit 2, each support piece 16 of medicine package case 1 is positioned at each of sensor portions S1-S7 (each gap between projection portions T1-T9), and a medicine package rests on a bottom surface (bottom surface of blocks 12*a*-12*g*) of medicine package case 1 including this support piece 16 (see FIG. 24).

Figure 24:
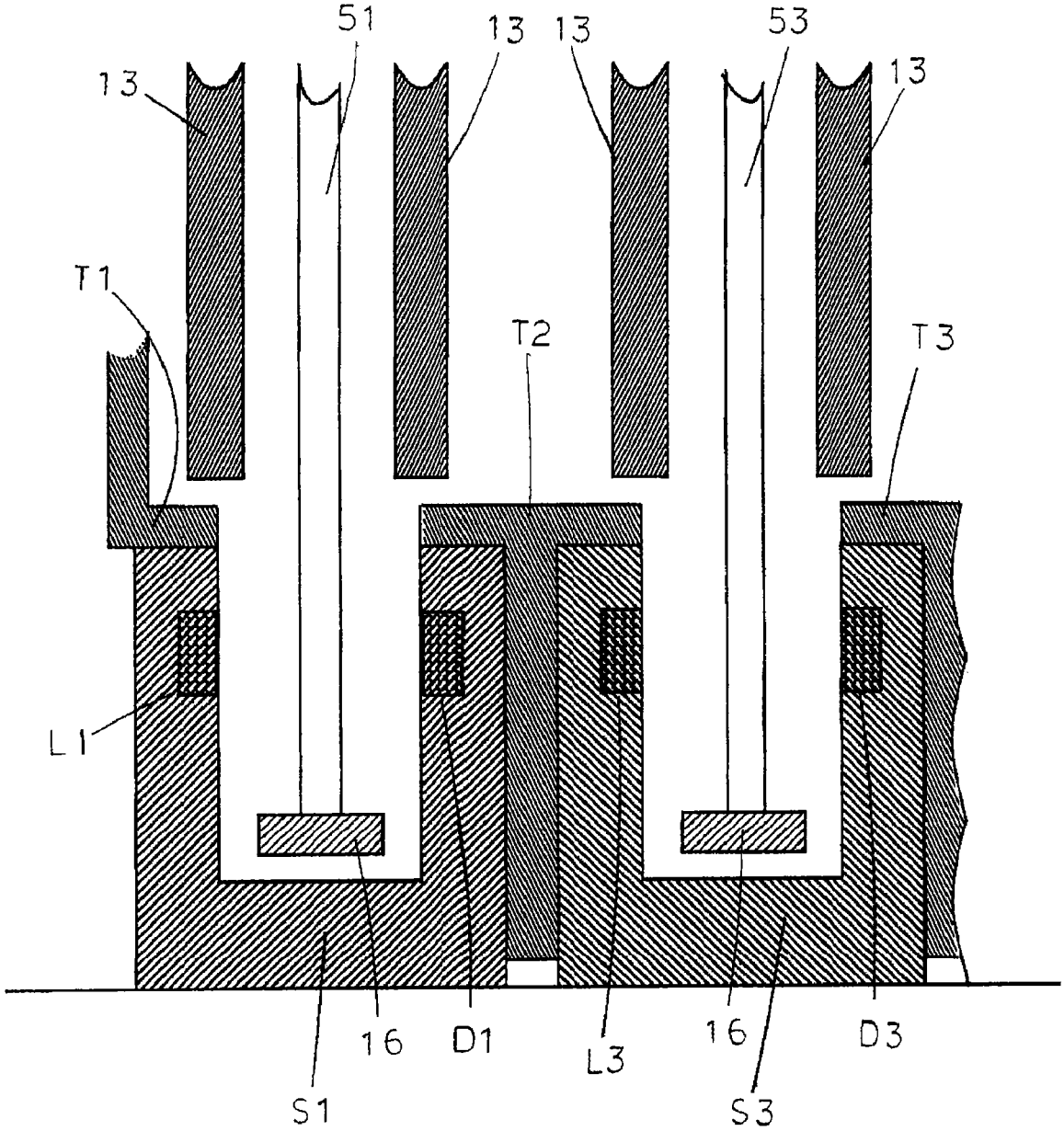
FIG. 24 is an enlarged cross-sectional view of a main part of the medication managing apparatus.

Though only partially shown in FIG. 24, only light-emitting diode L1 of sensor portion S1 is disposed at projection portion T1, photodiode D1 of sensor portion S1 and light-emitting diode L3 of sensor portion S3 are disposed at projection portion T2, photodiode D3 of sensor portion S3 and light-emitting diode L5 of sensor portion S5 are disposed at projection portion T3, photodiode D5 of sensor portion S5 and light-emitting diode L7 of sensor portion S7 are disposed at projection portion T4, and only photodiode D7 of sensor portion S7 is disposed at projection portion T5.

Furthermore, only light-emitting diode L2 of sensor portion S2 is disposed at projection portion T6, photodiode D2 of sensor portion S2 and light-emitting diode L4 of sensor portion S4 are disposed at projection portion T7, photodiode D4 of sensor portion S4 and light-emitting diode L6 of sensor portion S6 are disposed at projection portion T8, and only photodiode D6 of sensor portion S6 is disposed at projection portion T9. It is noted that the positions at which a light-emitting diode and a photodiode are disposed may be reversed.

In the case where medicine package case 1 is stored in storage portion 30, when no medicine package is present in blocks 12*a*-12*g* of medicine package case 1, each paired light-emitting diodes and photodiodes (photocoupler) L1-D1, L2-D2, . . . , L7-D7 face each other through opening 15 of opposing wall 13, and when a medicine package is present, each pair is blocked by the medicine package. In other words, when no medicine package is present in each of blocks 12*a*-12*g*, the photodiode receives light from the light-emitting diode, and when a medicine package is present, light is blocked by the medicine package and not received. A sense signal from L1-D1, L2-D2, . . . , L7-D7 is used to detect presence/absence of a medicine package in each block 12*a*-12*g*.

In addition, a switch lever 35 is swingably mounted on storage portion 30 in such a manner as to protrude from the wall surface in a normal state. A micro-switch 36 is provided in main body unit 2 which is turned on/off in a manner interlocked with switch lever 35 (FIG. 23). Here, switch lever 35 and micro-switch 36 constitute a medicine package case sensor.

In this medicine package sensor, when medicine package case 1 is not stored in storage portion 30, switch lever 35 protrudes from the wall surface of storage portion 30 to turn on micro-switch 36, and when medicine package case 1 is stored in storage portion 30, medicine package case 1 presses switch lever 35 to turn off micro-switch 36. Thus, the presence/absence of medicine package case 1 in storage portion 30 can be detected.

Alternatively, the on/off of micro-switch 36 may be reversed. More specifically, when medicine package case 1 is not stored in storage portion 30, micro-switch 36 may be turned off, and when stored, it may be turned on.

Though not shown in the figures, a cover opening/closing sensor for sensing opening/closing of cover 10 of medicine package case 1 is provided for main body unit 2. Based on a sense signal of this cover opening/closing sensor, it can readily be managed whether not only the user but also somebody else opens cover 10 of medicine package case 1.

Disposed inside main body unit 2 are light-emitting diodes L1-L7 and photodiodes D1-D7 of sensor portions S1-S7, micro-switch 36, the cover opening/closing sensor, and other electronic components 41, and in addition, a circuit board 40 to which display portion 3, button 4, speaker 9, a battery, and the like are electrically connected. A memory (not shown) in which medication-related information including the medication instruction time and the like are stored is installed on circuit board 40.

In the medication managing apparatus configured in this manner, when medicine package case 1 is stored in storage portion 30 of main body unit 2, medicine package case 1 presses switch lever 35 to turn off micro-switch 36 as described above, so that the presence of medicine package case 1 in storage portion 30 is detected. When medicine package case 1 is removed from storage portion 30, switch lever 35 returns to the original position and micro-switch 36 is turned on, so that the absence of medicine package case 1 in storage portion 30 is detected. On the other hand, when medicine package case 1 is stored in storage portion 30, flange 21 of medicine package case 1 positioned at flange reception portion 32 of main body unit 2 is fixed by slide knob 6 so that medicine package case 1 is not easily detached from storage portion 30.

On the other hand, as shown by an enlarged cross-sectional view of a main part in FIG. 24, when medicine package case 1 containing medicine packages 51-57 respectively in blocks 12*a*-12*g* is stored in storage portion 30 of main body unit 2, blocks 12*a*-12*g* of medicine package case 1 respectively correspond to sensor portions S1-S7 (respective gaps between projection portions T1-T9) of main body unit 2 and medicine packages 51-57 and support piece 16 are positioned at sensor portions S1-S7. As a matter of course, as described above, each paired light-emitting diodes-photodiodes L1-D1, L2-D2, . . . , L7-D7 are opposed to each other through openings 15 of respective blocks 12*a*-12*g*.

In FIG. 24, as medicine package 51 is present in block 12*a*, light from light-emitting diode L1 of sensor portion S1 is blocked by medicine package 51 and photodiode D1 does not receive the light. Based on the sense signal from this L1-D1, the presence of medicine package 51 in block 12*a* is detected. The same applies to block 12*c*. By contrast, when medicine package 51 is not present in block 12*a*, photodiode D1 receives light from light-emitting diode L1, and the absence of a medicine package in block 12*a* is detected based on the sense signal from L1-D1.

According to this medication managing apparatus, medicine package case 1 containing medicine packages can be removed from main body unit 2, so that when medicines are handed to the user under an instruction of a doctor or the like, the user need only bring only medicine package case 1 removed from main body unit 2 to the hospital, and medicines can be given to/received from the user and the hospital (doctor) without causing much trouble to the user, as compared with the case where the user brings main body unit 2 including medicine package case 1. Moreover, it is not necessary to carry main body unit 2 including the management function portion such as the medicine package sensor (sensor portions S1-S7) and the medicine package case sensor (switch lever 35 and micro-switch 36), thereby ensuring a stable operation of main body unit 2 containing an electronic circuit and the like.

In addition, in medicine package case 1, blocks 12*a*-12*g* are arranged in parallel with each other in the depth direction, each positioned orthogonally to the depth direction of main body unit 2, so that, in view of ergonomics, the medicine package stored in each of blocks 12*a*-12*g* can easily be visually recognized, and a medicine package can easily be put into each block 12*a*-12*g* and a medicine package can easily be taken out from each block 12*a*-12*g*.

Furthermore, since blocks 12*a*-12*g* are arranged to be alternately displaced in the orthogonal direction, sensor portions S1-S7 occupy only small spaces of block 12*a*-12*g*, thereby reducing the size of not only medicine package case 1 but also the entire main body unit 2 including medicine package case 1, accordingly. Moreover, when blocks 12*a*-12*g* are arranged alternately in the orthogonal direction, the positions of necessary medicine packages can be easily recognized thereby further facilitating removal of a medicine package.

In the foregoing embodiment, sensor portions S1-S7 as medicine package sensors are of a transmittance type in which a light-emitting diode and a photodiode are arranged opposed to each other. However, they may be of a reflectance type in which they are arranged on the same side. In this case, a medicine package may be light-reflective or light-absorptive depending on the manner of light detection. In the case of a light-reflective medicine package, in the presence of a medicine package, reflected light from the medicine package is received by the photodiode. In the case of a light-absorptive medicine package, in the absence of a medicine package, light from the light-emitting diode is reflected at the other side (opposing wall) and is then received by the photodiode.

In addition, if there is no particular need for individually specifying and monitoring medicine packages, a plurality of medicine packages may be detected by one sensor. For example, in the case where a transmittance-type sensor is used, it can be used in detection that the more medicine packages are, the less light passes through.

Figure 25:
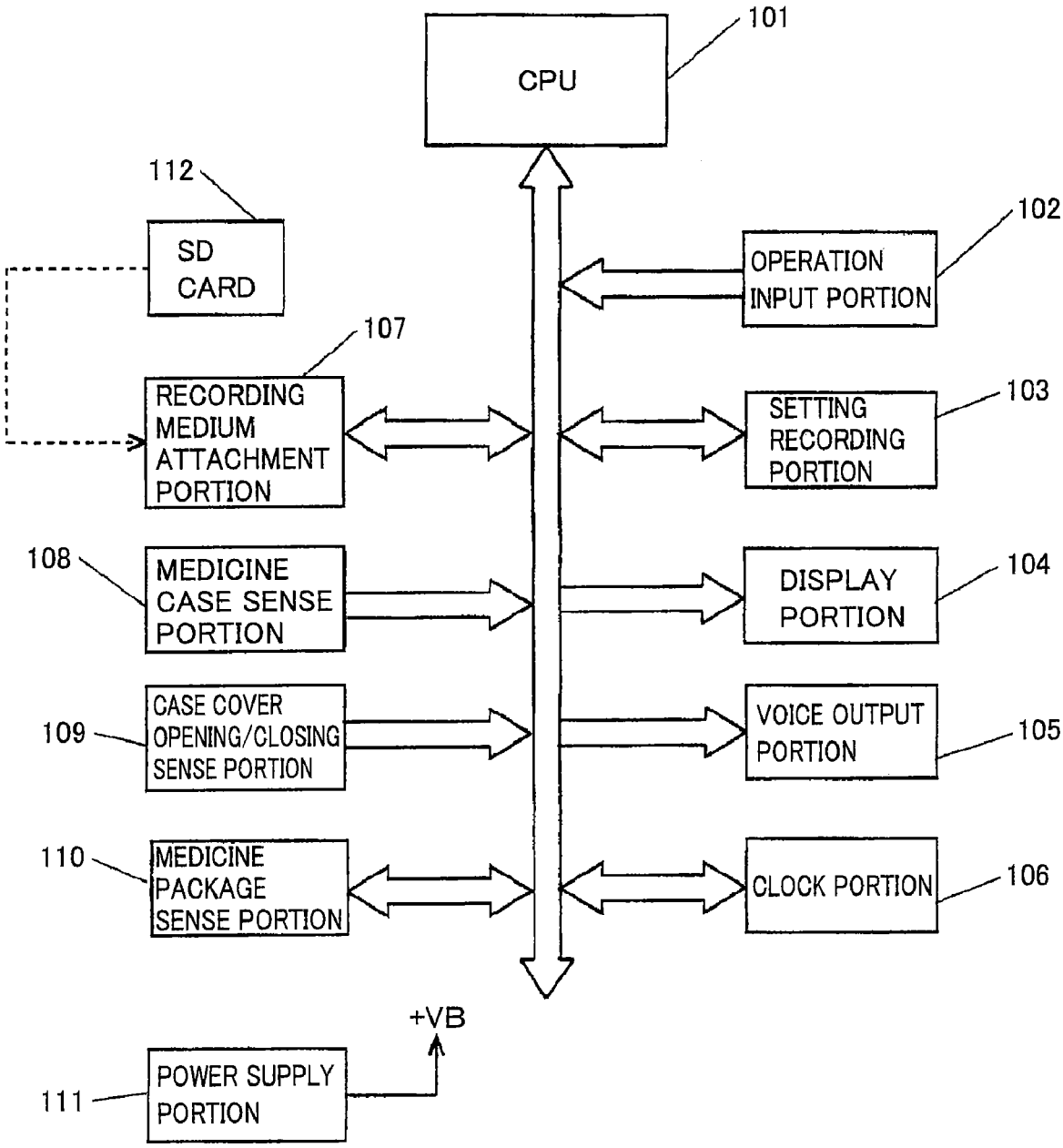
FIG. 25 is a block diagram showing a circuit configuration of the medication managing apparatus.

Next, a block diagram of an exemplary configuration of the aforementioned medication managing apparatus will be illustrated in FIG. 25. This medication managing apparatus includes a CPU 101 controlling the entire management processing, an operation input portion 102 including the aforementioned button 4, a setting recording portion 103 recording the present time, a dosing notice time, and a variety of any other setting values, a display portion 104 (the aforementioned display portion 3) for displaying the present time, a dosing instruction, and any other instructions, a voice output portion 105 (the aforementioned speaker 9) outputting a dosing instruction, any other instructions and notices by voice, a clock portion 106 counting the time, a recording medium attachment portion 107 (the aforementioned slot 5) receiving the attached SD card 112 (the aforementioned SD card 45), a medicine package case sense portion 108 (the aforementioned switch lever 35 and micro-switch 36) sensing that medicine package case 1 is stored in main body unit 2, a case cover opening/closing sense portion 109 (the aforementioned cover opening/closing sensor) sensing opening/closing of cover 10 of medicine package case 1, a medicine package sense portion 110 (the aforementioned sensor portions S1-S7) sensing the presence/absence of a medicine package in each of blocks 12*a*-12*g* of medicine package case 1, and a power supply portion 111 supplying a power supply voltage VB to each circuit component.

Figure 26:
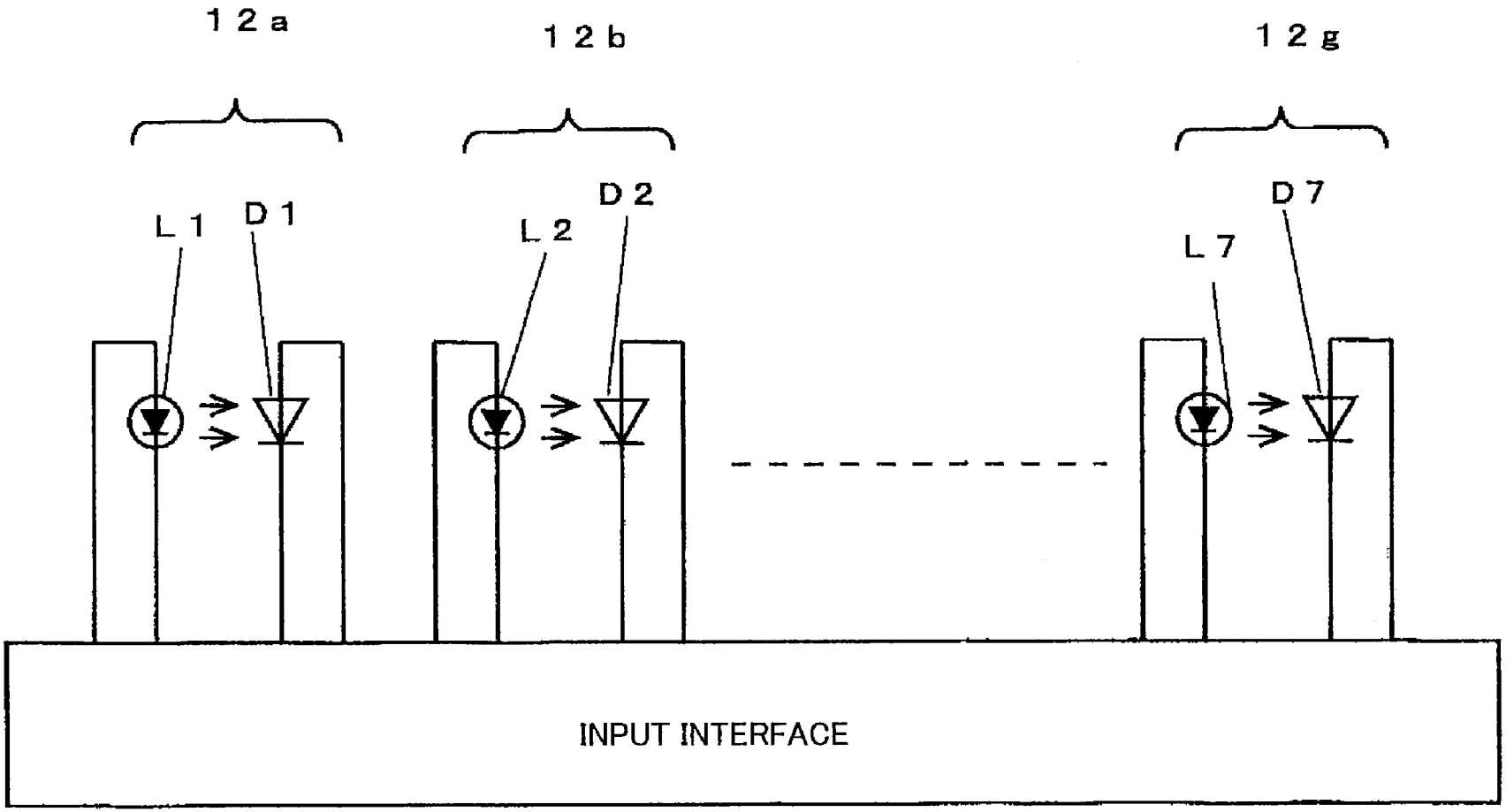
FIG. 26 is a diagram showing a schematic configuration of a medicine package sense portion in the block diagram of FIG. 25.
Figure 27:
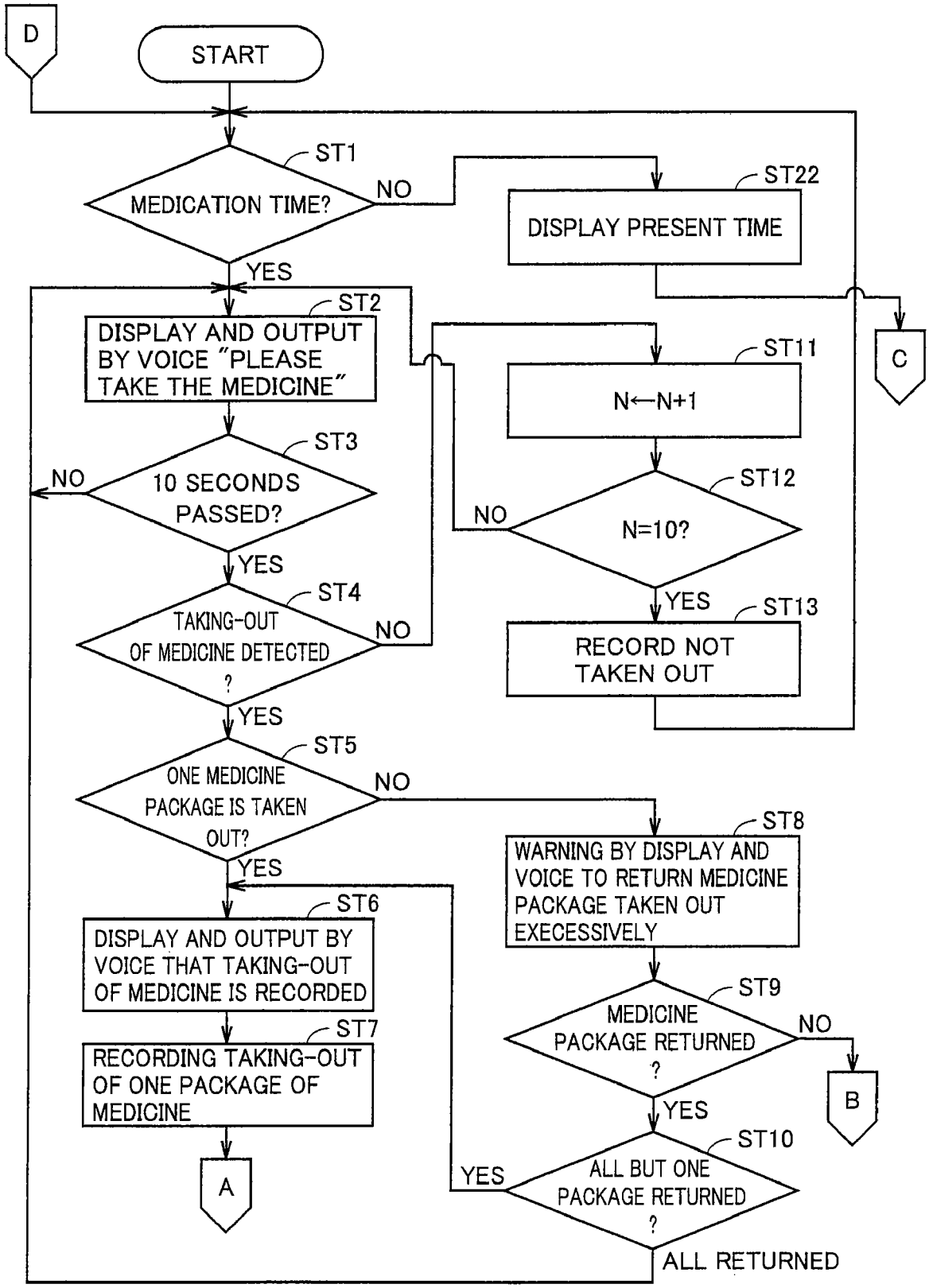
FIG. 27 is a flowchart illustrating a management processing operation of the medication managing apparatus.
Figure 28:
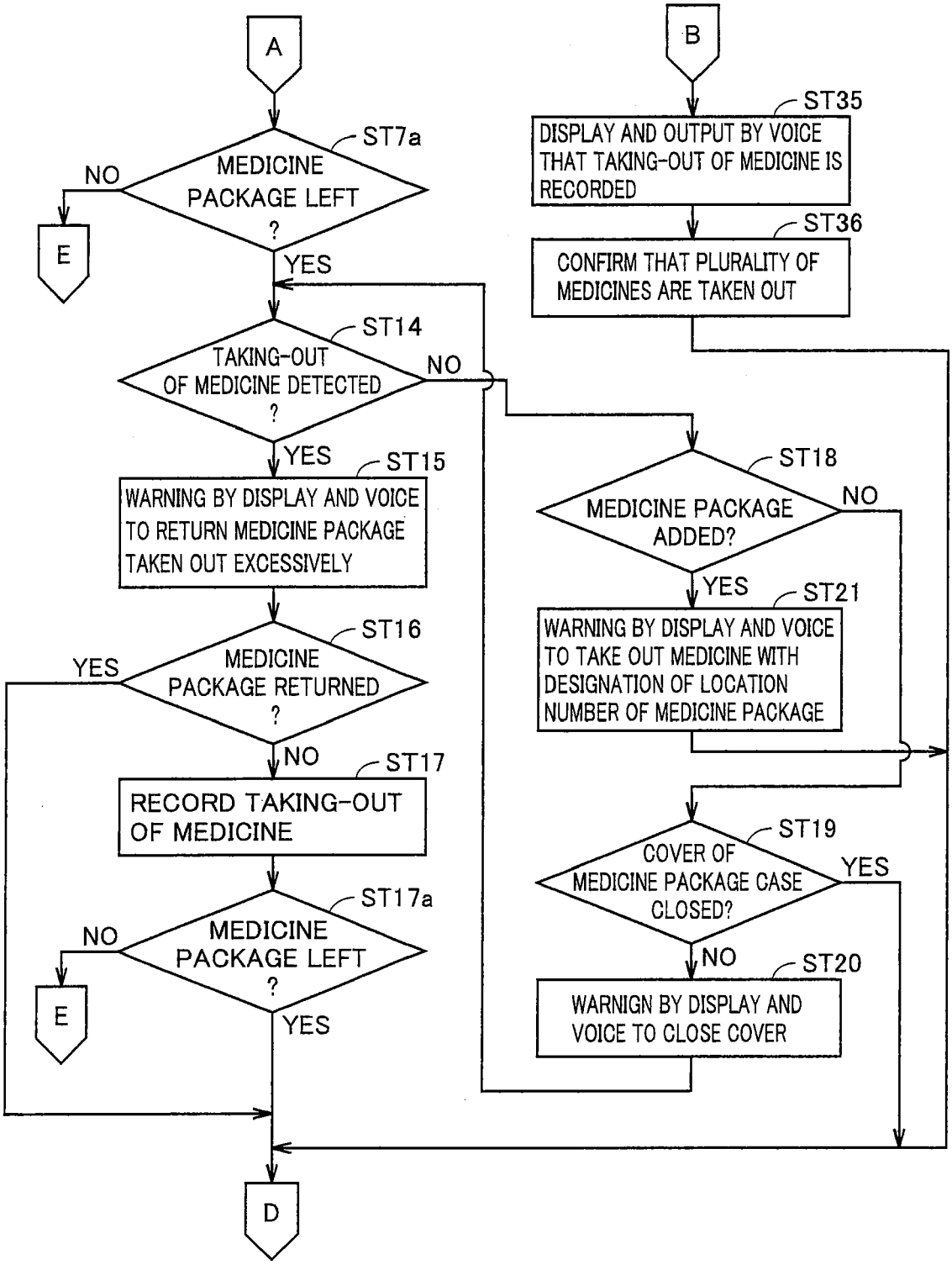
FIG. 28 is a flowchart illustrating the management processing operation of the medication managing apparatus, together with FIG. 27.
Figure 29:
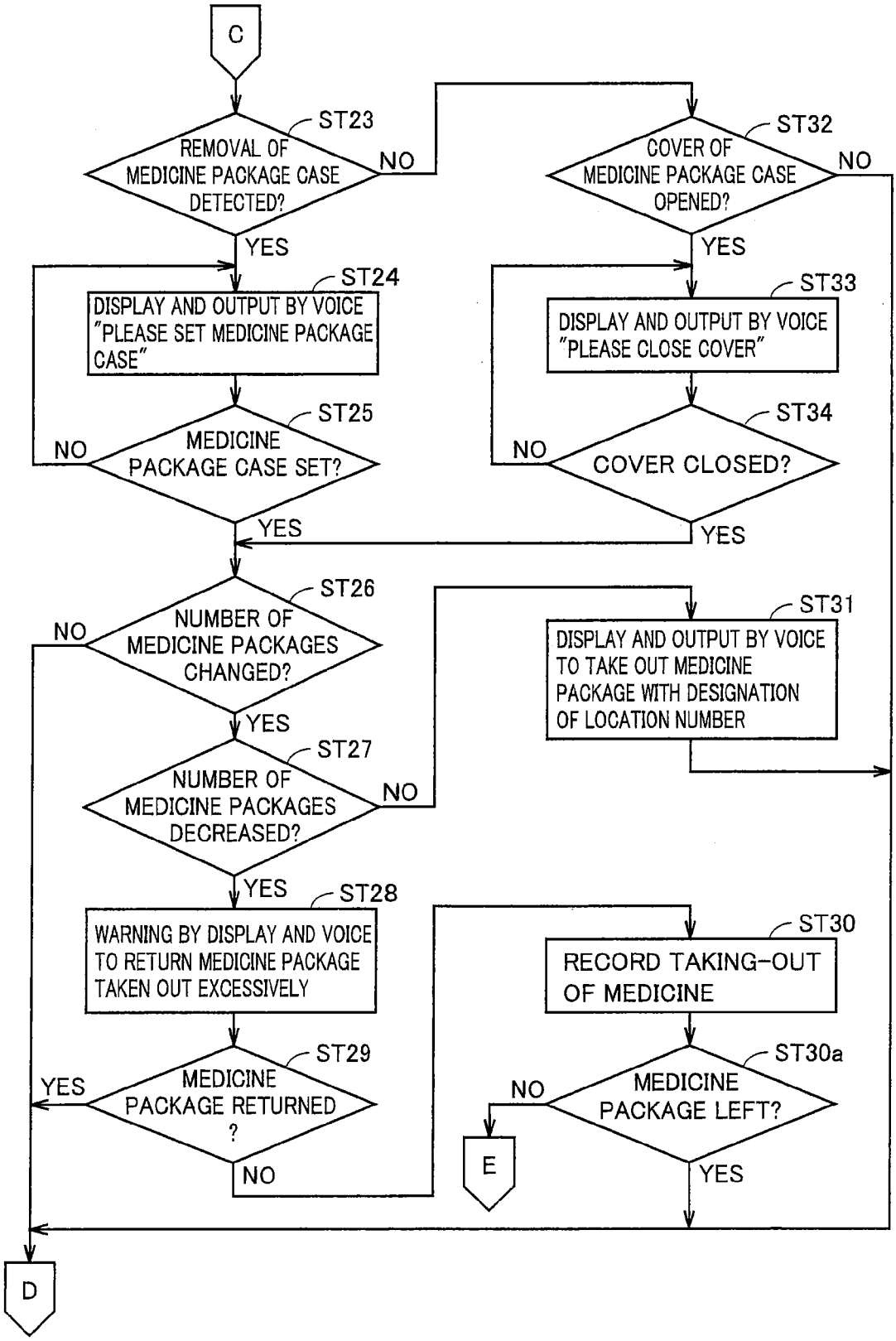
FIG. 29 is a flowchart illustrating the management processing operation of the medication managing apparatus, together with FIG. 27 and FIG. 28.
Figure 30:
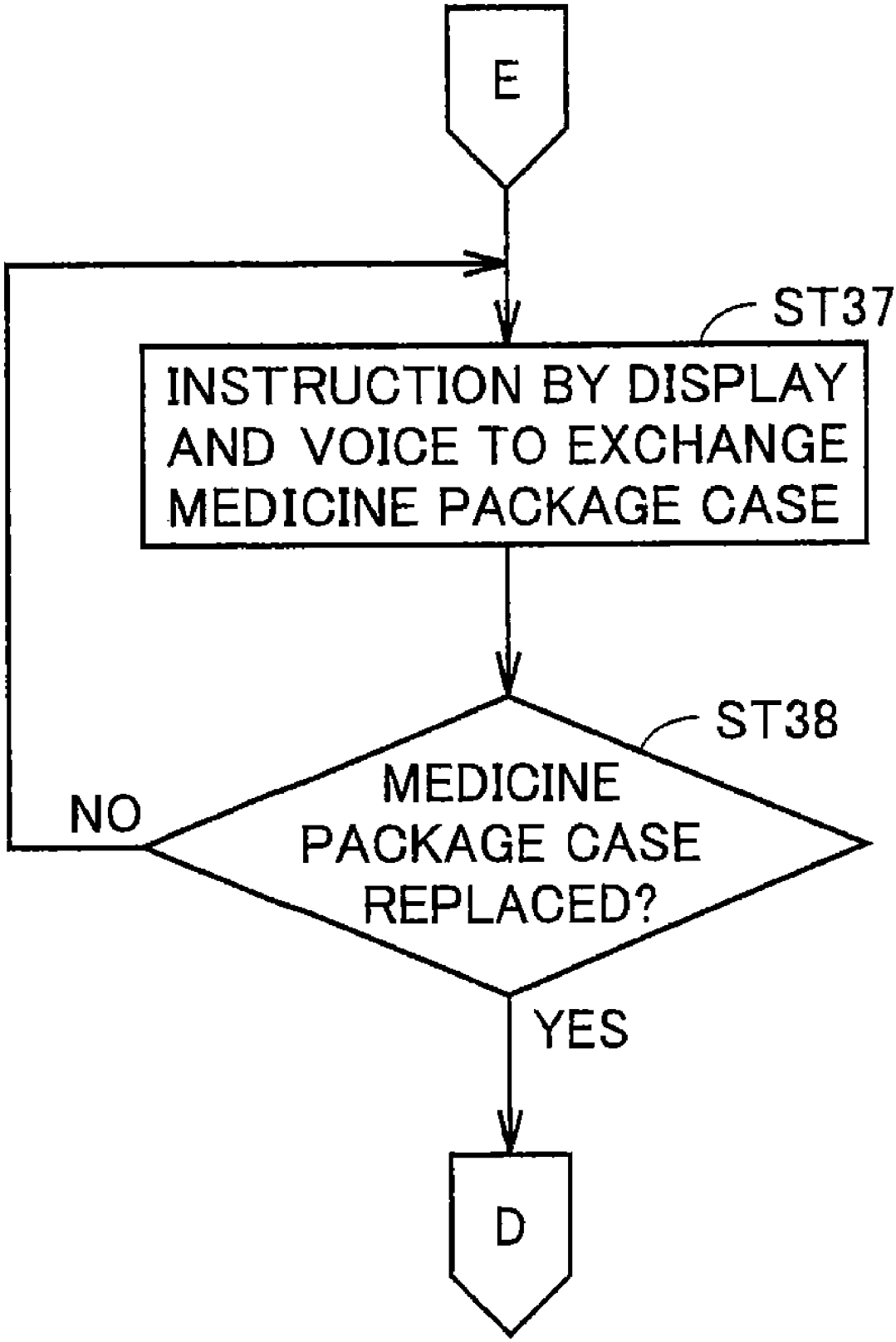
FIG. 30 is a flowchart illustrating the management processing operation of the medication managing apparatus, together with FIG. 27, FIG. 28 and FIG. 29.

A dosing instruction time and a main body unit ID are stored in SD card 112 when medicines are provided from a doctor to a recipient of drugs. SD card 112 additionally includes a region for storing the actual dosing time and any other management information. Medicine package sense portion 110 is provided with photocouplers formed of light-emitting diodes L1-L7 and photodiodes D1-D7 in respective blocks 12*a*-12*g*, as shown in FIG. 26.

Next, referring to the flowcharts shown in FIG. 27-FIG. 30, the managing processing operation of this medication managing apparatus will be described. Upon the start of the process, first, at step ST1, it is determined whether or not the medication time has come. If the medication time has not come, the process proceeds to step ST22. On the other hand, if the medication time has come, the process proceeds to step ST2. In the process in step ST2-ST20, the management at the time when the medication time has come is executed.

At step ST2, "Please take one package of medicine" appears on display portion 104, and "It is time to take your medicine. Please take out one package of medicine" is output by voice from voice output portion 105. Then, the process proceeds to step ST3. At step ST3, the process waits for ten seconds to pass and then proceeds to step ST4.

At step ST4, it is determined whether or not taking out of medicine (medicine package) is detected. If it is detected at medicine package sense portion 110 that the recipient takes out the medicine, the process proceeds to step ST5. On the other hand, if the medicine is not taken out, the process proceeds to step ST11. At step ST11, a variable N is incremented by one (initially, N=0), and the process then proceeds to step ST12. At step ST12, whether N=10 or not is determined. As initially N=1, if determination is "NO", the process returns to step ST2. At step ST2, again, "Please take the medicine" is displayed and output by voice.

Then, if the medicine is not taken out after the notice "please take the medicine" at the medication time, the notice "please take the medicine" is repeated every ten seconds. If the medicine is not taken out even after the notice is repeated ten times, the determination at step ST12 is "YES", and the process proceeds to step ST13. At step ST13, it is stored in SD card 112 that the medicine is not taken out at this medication instruction time. Then, the process returns to step ST2.

At step ST5, it is determined whether or not one medicine package is taken out. If one package is taken out, the process proceeds to step ST6. On the other hand, if a plurality of packages, rather than one, are taken out, the process proceeds to step ST8. At step ST6, it is displayed and output by voice that the taking out of the medicine is recorded, at display portion 104 and voice output portion 105. Then, the process proceeds to step ST7. At step ST7, the taking-out of one medicine package is recorded together with the taking-out time in SD card 112. Then, the process proceeds to step ST7*a*. At step ST7*a*, it is determined whether or not a medicine package is left. If left, the process proceeds to step ST14. On the other hand, if not left, the process proceeds to step ST37.

At step ST8, it is displayed and alarmed by voice to return the medicine package taken out excessively. Then, the process proceeds to step ST9. At step ST9, it is determined the medicine package has been returned. If the medicine package has been returned, the process proceeds to step ST10. On the other hand, if the medicine package is not returned, the process proceeds to step ST9*a*. At step ST9*a*, it is displayed and output by voice that "Taking-out of two or more medicines will be recorded". Then, the process proceeds to step ST9*b*. At step ST9*b*, it is recorded in SD card 112 that a plurality of medicine packages are taken out. Then, the process returns to step ST1.

At step ST10, it is determine whether all but one medicine package is returned or all are returned. If all but one is returned, the process proceeds to step ST6. Then, at step ST6, it is displayed and output by voice that the taking-out of medicine is recorded, and then at step ST7, the taking-out of one medicine package is recorded in SD card 112. Then, the process proceeds to step ST14. On the other hand, if at step ST10, all of the medicine packages taken out are returned, the process returns to step ST2.

At step ST14, it is further determined whether or not taking-out of medicine is detected. If taking-out of medicine is detected, the process proceeds to step ST15. On the other hand, if taking-out of medicine is not detected, the process proceeds to step ST18. At step ST15, a warning is displayed at display portion 104 and output by voice from voice output portion 105 to return the medicine package taken out excessively. Then, the process proceeds to step ST16. At step ST16, it is determined whether or not the medicine package has been returned. If the medicine package has been returned, the process returns to step ST1. On the other hand, if not returned, it is assumed that the medicine that has not been returned was taken out, and the process then proceeds to step ST17 to record taking-out of medicine in SD card 112. Then, the process proceeds to step ST17*a*. At step ST17*a*, it is determined whether or not a medicine package is left. If left, the process returns to step ST1. On the other hand, if not left, the process proceeds to step ST37.

At step ST18, it is determined whether or not a medicine package is added. If a medicine package is added to the medicine package case, for example, by returning one of the medicines taken out which should not be returned, the process proceeds to step ST21. On the other hand, if a medicine package is not added, the process proceeds to step ST19. At step ST21, a warning is displayed at display portion 104 and output by voice from voice output portion 105 to take out a medicine package with designation of a location number of the medicine package. Then, the process returns to step ST1.

At step ST19, it is determined whether or not the cover of the medicine package case has been closed. If the cover has been closed, the process returns to step ST1. On the other hand, if the cover is not closed, the process proceeds to step ST20. At step ST20, a warning is displayed at display portion 104 and output by voice from voice output portion 105 to close the cover. Then, the process returns to step ST14.

Next, the process at the time other than the medication time will be described. At step ST1, if it is determined that the present time is not the medication time, the process proceeds to step ST22 and the present time appears on display portion 104. Then, the process proceeds to step ST23. At step ST23, it is determined whether or not the medicine package case is removed. If the medicine package case is not removed from the main body unit, the process proceeds to step ST32. On the other hand, if it is detected that the medicine package case is removed from the main body unit, the process proceeds to step ST24.

At step ST32, it is determined whether or not the cover of the medicine package case is opened. If the cover is not opened, the step returns to step ST1. On the other hand, if the cover is opened, the process proceeds to step ST33. At step ST33, "please close the cover" is displayed at display portion 104 and output by voice from voice output portion 105. Then, the process proceeds to step ST34. At step ST34, it is determined whether or not the cover is closed. If not closed, the process returns to step ST33. On the other hand, if the cover is closed, the process proceeds to step ST26.

At step ST24, as the medicine package case is removed, "please set the medicine package case" is displayed at display portion 104 and output by voice from voice output portion 105. Then, the process proceeds to step ST25. At step ST25, it is determined whether or not the medicine package case is set. If the medicine package case is not set, the process returns to step ST24. On the other hand, if the medicine package case is set, the process proceeds to step ST26.

At step ST26, it is determined whether or not the number of medicine packages changes. If the number of medicine packages is not changed, the process returns to step ST1. On the other hand, if the number of medicine packages is changed, the process proceeds to step ST27. At step ST27, it is determined whether or not the number of medicine packages decreases. If the number of medicine packages decreases, the process proceeds to step ST28. On the other hand, if the number of medicine packages does not decrease (if increase), the process proceeds to step ST31.

At step ST28, a warning is displayed at display portion 104 and output by voice from voice output portion 105 to return the medicine package taken out excessively. Then, the process proceeds to step ST29. At step ST29, it is determined whether or not the medicine package has been returned. If returned, the process returns to step ST1. On the other hand, if the medicine package is not returned, the process proceeds to step ST30.

At step ST30, that a medicine package is taken out is recorded together with the time in SD card 112. Then, the process proceeds to step ST30*a*. At step ST30*a*, it is determined whether or not a medicine package is left. If left, the process returns to step ST1. On the other hand, if not left, the process proceeds to step ST37.

At step ST31, it is displayed at display portion 104 and output by voice from voice output portion 105 to take out a medicine package with designation of the location number thereof. Then, the process returns to step ST1.

At step ST37, such a guidance that "please set the next case" is given by display and voice to replace the medicine package case. Then, the process proceeds to step ST38. At step ST38, it is determined whether or not the medicine package case has been replaced. If the replacement is confirmed, the process returns to step ST1. On the other hand, if not yet replaced, the process returns to step ST37 and a guidance is given again by display and voice to replace the medicine package case.

INDUSTRIAL APPLICABILITY

According to the present invention, when a medicine is handed to the user under an instruction of a doctor or the like, the user need only bring only the medicine package case removed from the apparatus to the hospital so that the medicine can be given to/received from the user and the hospital (doctor) without causing much trouble to the user.

In addition, it is not necessary to carry the main body unit including the management function portion such as the medicine package sensor and the medicine package case sensor, thereby ensuring a stable operation of the apparatus.

The invention claimed is:

1. A medication managing apparatus, comprising:

a medicine package case; and a main body unit removably storing the medicine package case, and managing medication-related information including a medication instruction time, to give, at said medication instruction time, an instruction/notice of medication, wherein said medicine package case includes a plurality of blocks divided by walls and arranged in parallel with each other, each storing a medicine package containing a medicine to be taken by a user, and an openable/closable cover covering said plurality of blocks to allow the medicine package to be stored and taken out, wherein said main body unit includes a medicine package sensor sensing the medicine package in each said block, and a medicine package case sensor sensing attachment/removal of said medicine package case to/from said main body unit, wherein said medication managing apparatus comprises openings provided at opposing walls of said each block and formed at positions facing each other such that the medicine package stored in the block is sandwiched therebetween, and wherein said medicine package sensor is disposed corresponding to each said opening at the opposing walls of each said block, to sense a medicine package based on that the medicine package stored in the block blocks a gap between a pair of openings.

2. The medication managing apparatus according to claim 1, comprising a cover opening/closing sensor sensing opening/closing of the cover of said medicine package case.

3. The medication managing apparatus according to claim 1, comprising:

information storing means for storing said medication-related information; and notice means for giving, at said medication instruction time, a notice that said medication instruction time has come.

4. The medication managing apparatus according to claim 3, wherein said information storing means is a storage medium externally attached to said main body unit, and the medication managing apparatus comprises a storage medium attachment portion for attaching the storage medium.

5. The medication managing apparatus according to claim 4, comprising medication condition management means for causing said medication-related information to be stored in said storage medium based on said medication instruction time and a detection signal of said medicine package sensor, said medicine package case sensor and said cover opening/closing sensor.

6. The medication managing apparatus according to claim 1, wherein said blocks of said medicine package case are arranged in the depth direction of said main body unit, each positioned orthogonally to the depth direction of main body unit.

7. The medication managing apparatus according to claim 1, wherein a notch portion is provided at the opposing wall of said each block to extend downwardly from an upper edge of the wall.

* * * * *